US007817953B2

(12) United States Patent
Ishibashi et al.

(10) Patent No.: US 7,817,953 B2
(45) Date of Patent: Oct. 19, 2010

(54) IMAGE RECORDING MEDIUM, SHEET FEEDING DEVICE, AND IMAGE FORMING APPARATUS

(75) Inventors: Mikio Ishibashi, Kanagawa (JP); Reki Nakamura, Kanagawa (JP); Kazuhisa Sudo, Kanagawa (JP); Megumi Ohtoshi, Kanagawa (JP); Masafumi Yamada, Kanagawa (JP); Toshihiro Sugiyama, Tokyo (JP); Yukiko Iwasaki, Kanagawa (JP); Nobuyuki Koinuma, Kanagawa (JP); Takashi Sakamaki, Kanagawa (JP); Takeo Suda, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 714 days.

(21) Appl. No.: 11/649,204

(22) Filed: Jan. 4, 2007

(65) Prior Publication Data

US 2007/0164505 A1 Jul. 19, 2007

(30) Foreign Application Priority Data

| | | |
|---|---|---|
| Jan. 17, 2006 | (JP) | 2006-008207 |
| Feb. 3, 2006 | (JP) | 2006-027582 |
| Jun. 5, 2006 | (JP) | 2006-156714 |
| Jul. 11, 2006 | (JP) | 2006-190133 |

(51) Int. Cl.
*G03G 15/00* (2006.01)

(52) U.S. Cl. ..... 399/341; 156/227

(58) Field of Classification Search ..... 399/341, 399/342; 157/227, 204, 277
See application file for complete search history.

(56) References Cited

U.S. PATENT DOCUMENTS

| | | | | |
|---|---|---|---|---|
| 3,317,038 | A * | 5/1967 | Bade et al. | 206/313 |
| 4,063,641 | A * | 12/1977 | Kuehn et al. | 206/484 |
| 4,721,635 | A * | 1/1988 | Helinski | 428/15 |
| 5,223,357 | A * | 6/1993 | Lovison | 430/1 |
| 5,303,003 | A | 4/1994 | Jamzadeh | |
| 5,337,132 | A * | 8/1994 | Cherian | 430/126.1 |
| 6,121,989 | A | 9/2000 | Song | |
| 6,718,145 | B2 | 4/2004 | Ohta et al. | |
| 7,260,354 | B2 * | 8/2007 | Ishida | 399/409 |
| 2003/0044189 | A1 | 3/2003 | Okitsu et al. | |
| 2005/0196203 | A1 * | 9/2005 | Tsuda et al. | 399/341 |
| 2006/0133871 | A1 * | 6/2006 | Ishida | 399/341 |
| 2007/0025782 | A1 * | 2/2007 | Tamura et al. | 399/322 |
| 2008/0013976 | A1 * | 1/2008 | Tsuda et al. | 399/67 |

(Continued)

FOREIGN PATENT DOCUMENTS

| | | |
|---|---|---|
| EP | 1 352 863 | 10/2003 |

(Continued)

OTHER PUBLICATIONS

European Search Report dated Jul. 2, 2007.

(Continued)

*Primary Examiner*—Kaitlin S Joerger
(74) *Attorney, Agent, or Firm*—Harness, Dickey & Pierce, P.L.C.

(57) ABSTRACT

A pair of registration rollers align a leading edge of a recording medium having a transparent section and a non-transparent section. A boundary sensor detects a boundary between the transparent section and the non-transparent section. The boundary sensor is provided on a downstream side of a direction of conveying the recording medium by the registration rollers.

13 Claims, 29 Drawing Sheets

U.S. PATENT DOCUMENTS

| | | | | |
|---|---|---|---|---|
| 2008/0135160 | A1* | 6/2008 | Iwasaki et al. | 156/227 |
| 2008/0236736 | A1* | 10/2008 | Nakamura et al. | 156/277 |

FOREIGN PATENT DOCUMENTS

| | | |
|---|---|---|
| JP | SHO 61-102569 U | 6/1986 |
| JP | 63-113576 | 5/1988 |
| JP | 05-035151 | 2/1993 |
| JP | 07-056409 | 3/1995 |
| JP | 07-080971 | 3/1995 |
| JP | 3047065 U | 1/1998 |
| JP | 10-123879 | 5/1998 |
| JP | 10-278183 | 10/1998 |
| JP | 2000-321842 | 11/2000 |
| JP | 2001-001560 | 1/2001 |
| JP | 2001-305894 | 11/2001 |
| JP | 2002-019392 | 1/2002 |
| JP | 2002-341623 | 11/2002 |
| JP | 2002-372931 | 12/2002 |
| JP | 2003-015524 | 1/2003 |
| JP | 2003-029581 | 1/2003 |
| JP | 2003-091110 | 3/2003 |
| JP | 2003-206455 | 7/2003 |
| JP | 2003-208114 | 7/2003 |
| JP | 2003-270991 | 9/2003 |
| JP | 2003-291533 | 10/2003 |
| JP | 2004-037565 | 2/2004 |
| JP | 2004-045874 | 2/2004 |
| JP | 2004-184553 | 7/2004 |
| JP | 2004-191678 | 7/2004 |
| JP | 2004-302044 | 10/2004 |
| JP | 2005-008417 | 1/2005 |
| JP | 2005-010529 | 1/2005 |
| JP | 2006-076239 | 3/2006 |

OTHER PUBLICATIONS

Chinese Office Action dated Jul. 25, 2008.
Japanese Office Action dated Sep. 14, 2009 issued in corresponding Japanese Application No. 2006-026601.

* cited by examiner

SURFACE LAYOUT OF SHEET TO BE
NORMALLY FOLDED IN CENTER

SURFACE LAYOUT ON SHEET FOR PHOTOGRAPHIC PRINT
(IMAGE SURFACE IS SET ON TRANSPARENT MEDIUM SIDE)

RECORDING MEDIUM IS DISCHARGED WITH IMAGE SURFACE FOLDED TO INNER SIDE OF CENTER FOLDING WITHOUT REVERSING RECORDING MEDIUM

IMAGE RECORDING MEDIUM, SHEET FEEDING DEVICE, AND IMAGE FORMING APPARATUS

CROSS-REFERENCE TO RELATED APPLICATIONS

The present document-incorporates by reference the entire contents of Japanese priority document, 2006-008207 filed in Japan on Jan. 17, 2006, Japanese priority document, 2006-027582 filed in Japan on Feb. 3, 2006, Japanese priority document, 2006-156714 filed in Japan on Jun. 5, 2006, and Japanese priority document, 2006-190133 filed in Japan on Jul. 11, 2006.

BACKGROUND OF THE INVENTION

1. Field of the Invention

The present invention relates to an image recording medium, a sheet feeding device for the image recording medium, and an image forming apparatus that realizes print output of highly glossy photograph images according to execution of folding and heat-bonding of the image recording medium in a post-processing device after image formation.

2. Description of the Related Art

In recent years, as it is well known, technical attempts concerning various image forming apparatus have been carried out to obtain glossy images of a photographic image quality. In the present invention, a structure of an image forming apparatus that forms images of a photographic image quality on a recording medium including a transparent section and a non-transparent section is explained.

In the conventional technology disclosed in Japanese Patent Application Laid-Open No. 2000-321842, a sensor that detects reflected light from a recording medium is provided in a position on an upstream side in a recording medium conveying direction of registration rollers. A type of the recording medium is distinguished based on a result of the detection by the sensor.

On the other hand, in Japanese Patent Application Laid-Open No. 2005-10529, an image recording medium including a transparent section and a non-transparent section is disclosed.

In the conventional technology described in Japanese Patent Application Laid-Open No. 2000-321842, the sensor is provided in the position on the upstream side in the recording medium conveying direction of the registration rollers. Thus, when a difference in an amount of sag of the recording medium nipped between the registration rollers occurs or a leading edge of the recording medium shifts obliquely, it is difficult to accurately detect a boundary between the transparent section and the non-transparent section of the recording medium disclosed in Japanese Patent Application Laid-Open No. 2005-10529.

Various technical attempts described in (A) to (F) below have been carried out to obtain glossy images of a photographic image quality.

(A) As an example of an image forming apparatus, there is a color image forming apparatus including an intermediate transfer member onto which different color toner images of a plurality of colors are multiply transferred from at least one image bearing member, a transparent-toner developing unit that develops a transparent toner image, a second transfer unit that transfers the color toner images and the transparent toner image formed on the intermediate transfer member onto a transfer material, and a fixing unit that fixes the color toner images and the transparent toner image formed on the transfer material (see Japanese Patent Application Laid-Open No. 2002-341623). In the conventional example, high glossiness is obtained by, after usual image formation is carried out on a sheet, uniformly forming a transparent toner image over the sheet before the sheet is conveyed to the fixing unit and fixing the transparent toner image.

However, in this technology, for example, a heavy load is applied to the fixing unit because a transparent toner is always supplied to the entire surface of the sheet and there is a difference in toner thickness between an image section and a non-image section of the sheet.

(B) As an example of an image recording medium, there is a receiving sheet for electrophotography that has a toner receiving layer on one surface of a support member and a back layer on the other surface. The support member has a thermoplastic resin layer(s) on one surface or both surfaces of a base thereof. Binders in an uppermost layer on the toner receiving layer side and an uppermost layer on the back layer side are soap-free water-dispersed polymer having a glass transition temperature (Tg) of 20° C. to 80° C. At least one of the toner receiving layer and the back layer contains a polymeric antistatic agent (see Japanese Patent Application Laid-Open No. 2004-191678). In the receiving sheet, a special recording medium is used to make the receiving sheet glossy. Thermoplastic resin layers are provided in the front and the back of a sheet and, after normally fixing an image on the sheet, pressure and heat are further applied thereto to realize uniform glossiness on the surface thereof.

However, the effect of this technology is realized when the receiving sheet is used together with a special fixing device disclosed in Japanese Patent Application Laid-Open No. 2004-191678. Thus, there are problems in terms of a structure, cost, power consumption, and the like.

(C) As an example of a fixing unit, there are two fixing units, as a first fixing unit and a second fixing unit, provided in an image forming apparatus (see Japanese Patent Application Laid-Open No. 2003-270991). In this conventional technology, after usual fixing of a toner image (the first fixing unit), the fixing unit including a highly smooth belt melts a toner again and, then, cools and peels off the toner to obtain uniform glossiness making use of the smoothness of the belt.

However, as in (B) above, there are problems in terms of a structure, cost, power consumption, and the like.

(D) As an example of an image recording medium, there is an image display plate. In the image display plate, a transparent film and a print surface reversely printed on the rear surface of the transparent film are provided. A light back-reflection sheet is provided on the print surface of the transparent film. An adhesive surface is provided on a surface of the light back-reflection sheet corresponding to the print surface. The adhesive surface and the print surface are integrated (see Japanese Patent Application Laid-Open No. 2004-302044).

However, this technology is provided on condition that the light back-reflection sheet, on which it is difficult to print an image, is used. Since it is difficult to print an image on the light back-reflection sheet, the 0.5 transparent film is used to form the image display plate. It is not an object to the technology to pursue a photographic image quality.

(E) As an example of an image recording medium, an adhesive layer is formed on a transparent film and the transparent film is bonded to an image surface (a print surface) in the technology disclosed in Japanese Patent Application Laid-Open No. H10-278183.

However, since adhesiveness of an image and the transparent film is low, it is impossible to reproduce a photographic image quality.

(F) As an example of an image recording medium, an invention related to a heat sensitive adhesive that is heated to have adhesion is disclosed in Japanese Patent Application Laid-Open No. 2003-206455. However, the invention does not examine a technology for obtaining a photographic image having a simple structure and a satisfactory storage life. It is possible obtain a photographic image having a simple structure and a satisfactory storage life by bonding a recording medium having, in a part thereof, a transparent section and a non-transparent white medium including an adhesive layer and forming the recording medium and the non-transparent white medium as an integral recording medium.

However, since the recording medium formed has the adhesive layer, it is necessary to contrive a stocking method and a conveying method for the recording medium. Moreover, in bonding the medium and the recording medium, since a bonding position is determined at a point when an adhesive surface of the medium comes into contact with the recording medium, it is necessary to contrive positioning of the medium before bonding.

As described above, in all the conventional technologies (A) to (F), structures of image forming apparatuses are complicated and there are problems in terms of cost, power consumption, a storage life of an image, and the like.

SUMMARY OF THE INVENTION

It is an object of the present invention to at least partially solve the problems in the conventional technology.

A sheet feeding device according to one aspect of the present invention includes a pair of registration rollers that align a leading edge of a recording medium having a transparent section and a non-transparent section; and a boundary sensor that detects a boundary between the transparent section and the non-transparent section. The boundary sensor is provided on a downstream side of a direction of conveying the recording medium by the registration rollers.

An image forming apparatus according to another aspect of the present invention includes the sheet feeding device according to the present invention; and an image forming unit that forms an image on the recording medium. The recording medium is configured to be folded along the boundary between the transparent section and the non-transparent section to superimpose the transparent section on the non-transparent section.

An image recording medium according to still another aspect of the present invention includes a recording medium that is a sheet-like medium, on which an image is formed by an image forming apparatus, including a transparent section; an overlapping medium configured to overlap the transparent section; and an adhesive layer on which an adhesive is applied. The overlapping medium is integrated with an image formation surface of the transparent section via the adhesive layer.

An image forming apparatus according to still another aspect of the present invention includes a conveyance path for conveying the image recording medium according to the present invention; an image forming unit that forms an image on the image recording medium; and a control unit that reverses the image horizontally or vertically when forming the image in the transparent section.

An image forming apparatus according to still another aspect of the present invention forms an image on the image recording medium according to the present invention.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
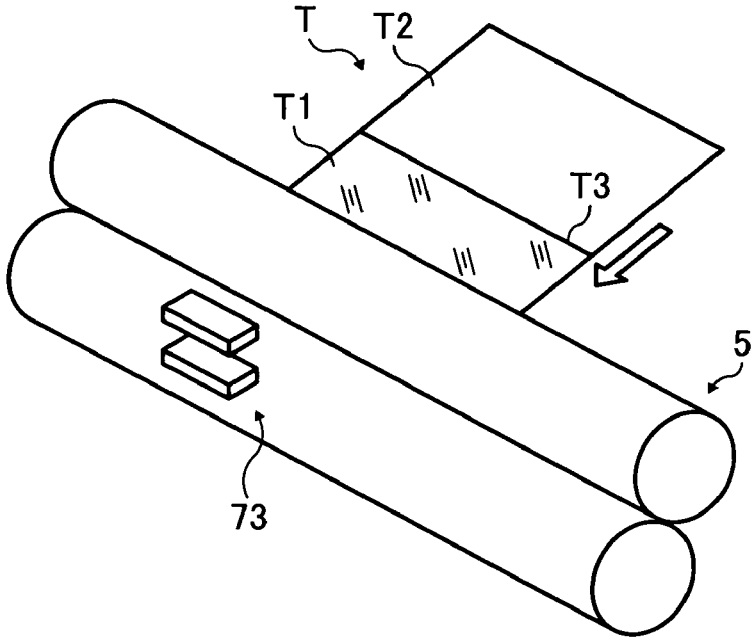
FIG. 1 is a perspective view of an internal structure of an image forming apparatus according to a first embodiment of the present invention.
Figure 2:
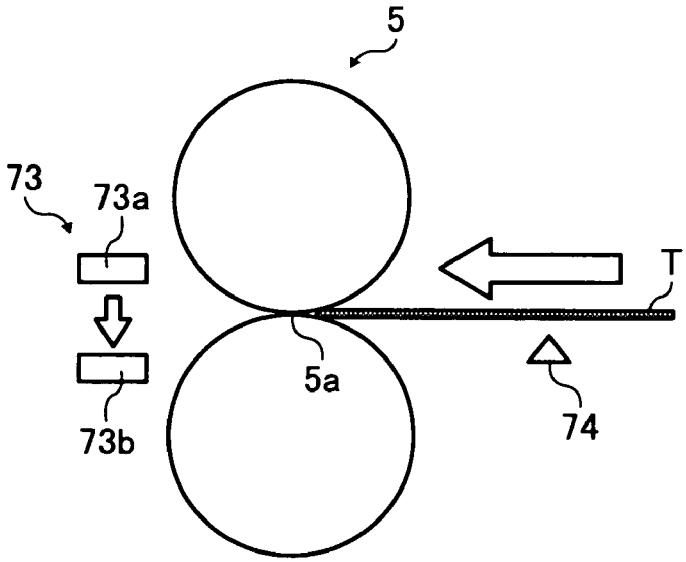
FIG. 2 is an enlarged sectional view of a main part of a sheet feeding device of the image forming apparatus according to the first embodiment.
Figure 3:
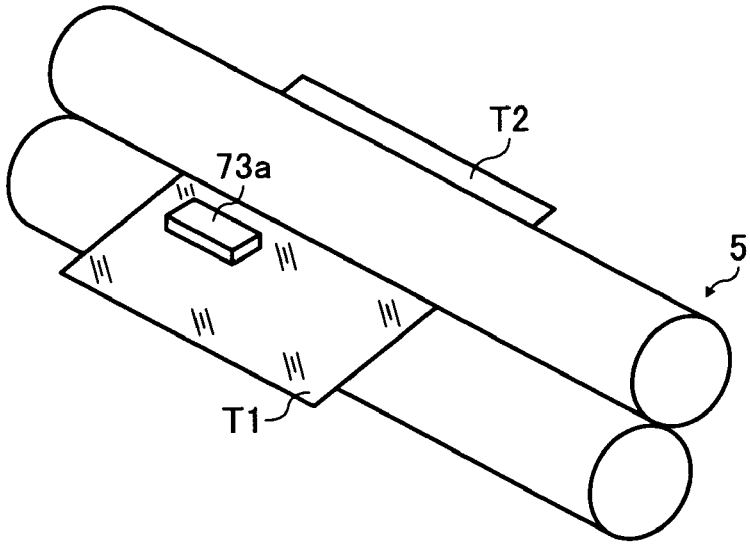
FIG. 3 is a perspective view of detection of a recording medium by a boundary sensor of the sheet feeding device according to the first embodiment.
Figure 4:
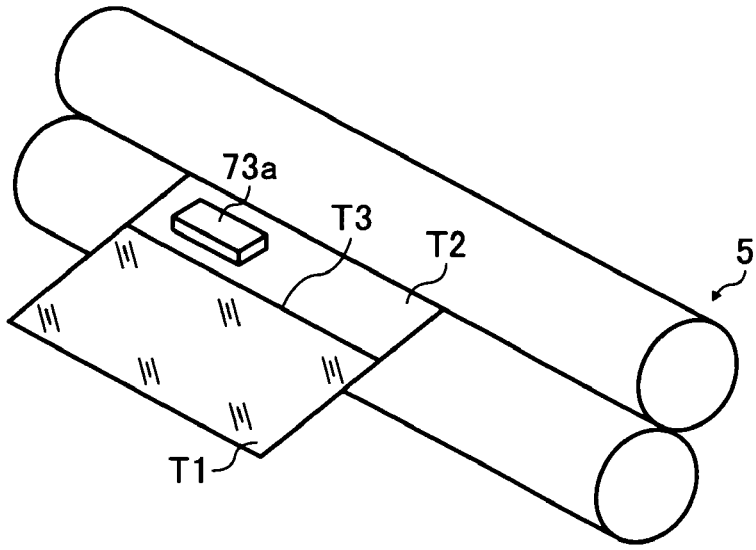
FIG. 4 is a perspective view of detection of a boundary between a transparent section and a non-transparent section of the recording medium by the boundary sensor of the sheet feeding device according to the first embodiment.
Figure 5:
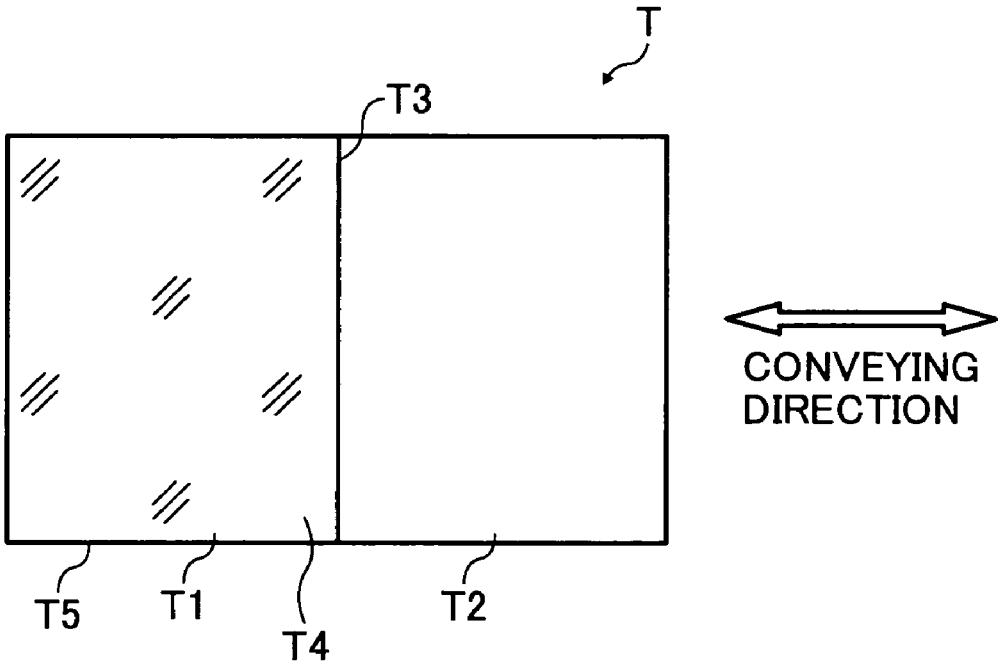
FIG. 5 is a plan view of the recording medium used in the first embodiment.
Figure 6:
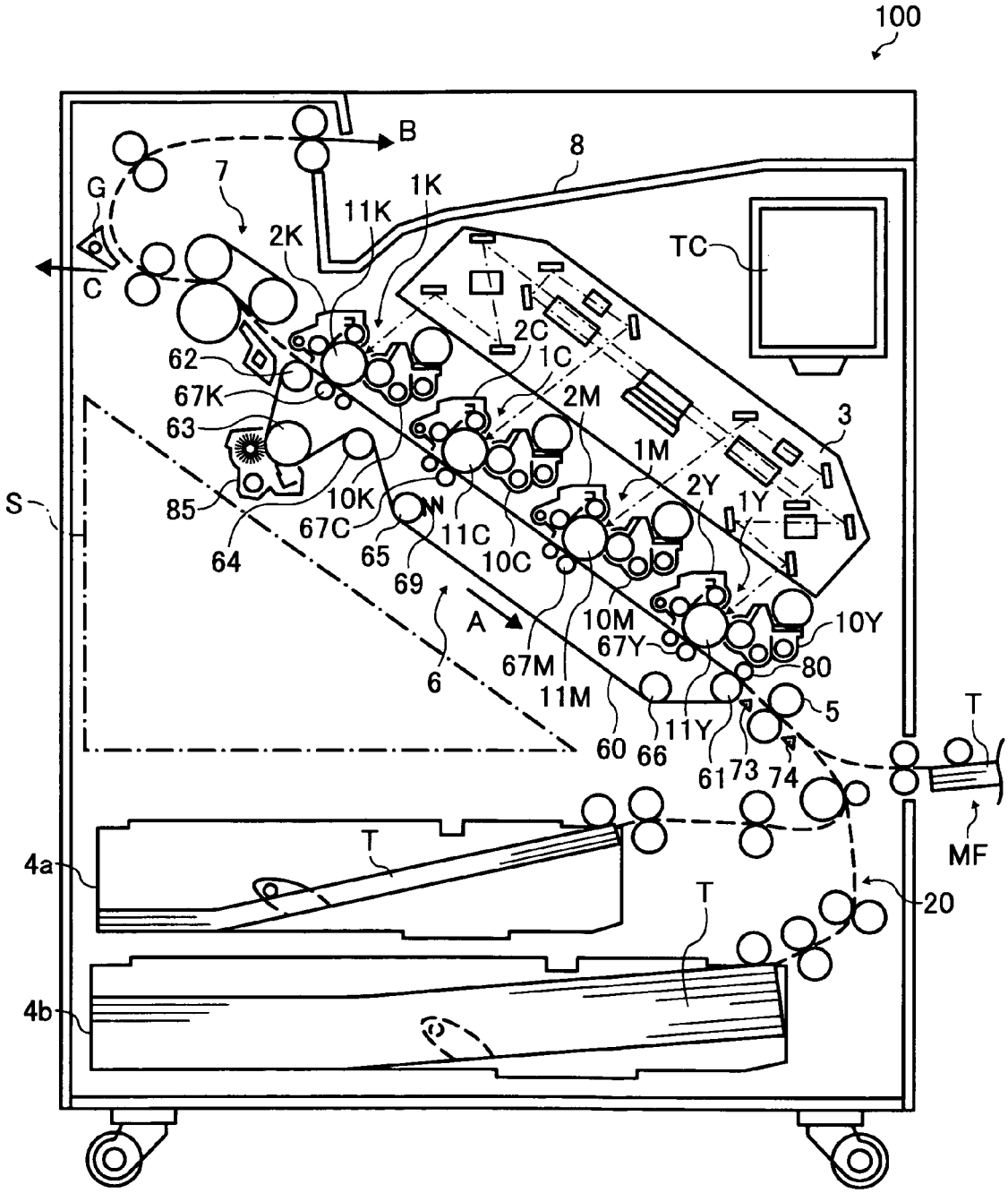
FIG. 6 is a sectional view of an entire structure of the image forming apparatus according to the first embodiment.

FIG. 1 is an enlarged perspective view of a main part of a sheet feeding device of an image forming apparatus according to a first embodiment of the present invention. FIG. 2 is an enlarged sectional view of the main part of the sheet feeding device of the image forming apparatus according to the first embodiment. FIG. 3 is a perspective view of detection of a recording medium by a boundary sensor of the sheet feeding device according to the first embodiment. FIG. 4 is a perspective view of detection of a boundary between a transparent section and a non-transparent section of the recording medium by the boundary sensor of the sheet feeding device according to the first embodiment. FIG. 5 is a plan view of the recording medium used in the first embodiment. FIG. 6 is a sectional view of an overall structure of the image forming apparatus according to the first embodiment.

In FIG. 6, an image forming apparatus 100 according to the first embodiment includes four image forming units (image forming means) 1Y, 1M, 1C, and 1K that form images of respective colors of yellow (Y), magenta (M), cyan (C), and black (K). The image forming units 1Y, 1M, 1C, and 1K include photosensitive drums 11Y, 11M, 11C, and 11K serving as image bearing members, developing units 10Y, 10M, 10C, and 10K, and photosensitive units 2Y, 2M, 2C, and 2K, respectively. The photosensitive units include charging units and cleaning unit, respectively.

An optical writing unit 3 including a light source, a polygon mirror, an f-θ lens, and a reflection mirror is arranged above the image forming units 1Y, 1M, 1C, and 1K. The optical writing unit 3 irradiates a laser beam on the surfaces of the respective sensitive drums 11Y, 11M, 11C, and 11K while scanning the surfaces with the laser beam. A transfer unit 6 serving as a belt driving device is arranged below the image forming units 1Y, 1M, 1C, and 1K. The transfer unit 6 has a transfer conveyor belt 60 that conveys a recording medium T to pass transfer sections of the respective image forming units 1Y, 1M, 1C, and 1K. A cleaning device 85 including a brush roller and a cleaning blade is arranged to be in contact with the outer peripheral surface of the transfer conveyor belt 60. Foreign matters such as a toner adhering on the transfer conveyor belt 60 are removed by the cleaning device 85. The transfer conveyor belt 60 is driven to convey the recording medium T in an A direction in the figure by conveyor-belt driving rollers 61, 62, 63, and 66, a conveyor-belt armored roller 64, and a conveyor-belt tension roller 65 while being pulled by a spring 69 at a fixed tension set in advance. A belt opposed roller 80 is arranged in a position opposed to the conveyor belt driving roller 61 in a section where the recording medium T starts to be conveyed by the transfer conveyor belt 60.

A fixing unit 7 of a belt fixing system, a sheet discharge tray 8, and a toner supply container TC are provided above the transfer unit 6. In the figure, a waste toner bottle, a duplex/reversal unit, a power supply unit, and the like are provided in a space S indicated by an alternate long and two short dashes line. A sheet feeding unit (a sheet feeding device) 20 are provided in a lower part of the image forming apparatus 100. The sheet feeding unit 20 includes sheet feeding cassettes 4*a* and 4*b* in which recording media T are placed and registration rollers 5 that align a leading edge position of the recording medium T with front positions of the image forming units 1Y, 1M, 1C, and 1K. A registration sensor 74 is provided on the upstream side of the registration rollers 5. A boundary sensor 73 is provided on the downstream side of the registration rollers 5. A manual feed tray MF for manually feeding sheets is provided on a side of the image forming apparatus 100.

As shown in FIG. 5, the recording medium T has a transparent section T1 in one half thereof and a non-transparent section T2 in the other half. A position substantially in the center in a conveying direction of the recording medium T is a boundary T3 between the transparent section T1 and the non-transparent section T2. The non-transparent section T2 is white. In the recording medium T, a front surface T4 of the transparent section T1 is an image formation surface. The front surface T4 is formed as a smooth surface to obtain a photographic highly glossy image. If a rear surface T5 of the transparent section T1 serving as a non-image formation surface is also formed as a smooth surface, a photographic image quality having higher glossiness is obtained.

In FIG. 2, the registration sensor 74 is provided in an upstream position in the recording medium T conveying direction of the registration rollers 5. In response to a detection signal of the registration sensor 74, the registration rollers 5 are put on standby in a state in which the recording medium T is in contact with a nip section 5*a* of the registration rollers 5. The boundary sensor 73 that detects a boundary between the transparent section T1 and the non-transparent section T2 of the recording medium T is provided in a downstream position in the recording medium T conveying direction of the registration rollers 5.

The boundary sensor 73 is a transmission photosensor. The boundary sensor 73 includes a light emitting unit 73*a* that emits light to a conveyance surface of the recording medium T and a light receiving unit 73*b* that is provided in a position opposed to the light emitting unit 73*a* and detects the light from the light emitting unit 73*a*. As shown in FIG. 1, the recording medium T is conveyed to the nip section 5*a* of the registration rollers 5. The transparent section T1, the non-transparent section T2, and the boundary T3 between the transparent section T1 and the non-transparent section T2 are provided in the recording medium T1. The boundary sensor 73 is arranged on the downstream side of the registration rollers 5. When the recording medium T is further conveyed, as shown in FIG. 3, the transparent section T1 of the recording medium T is placed between the light emitting unit 73*a* and the light receiving unit 73*b* hidden under the transparent section T1. At this point, the light receiving unit 73*b* is receiving the light from the light emitting unit 73*a* and transmitting a light reception signal to a control unit. When the recording medium T is further conveyed, the boundary T3 between the transparent section T1 and the non-transparent section T2 of the recording medium T reaches the position of the boundary sensor 73. Then, the control unit senses the light reception signal and detects the boundary T3 between the transparent section T1 and the non-transparent section T2 of the recording medium T. When the recording medium T is further conveyed, the non-transparent section T2 of the recording medium T is located in the position of the boundary sensor 73. Then, as shown in FIG. 4, in the boundary sensor 73, the non-transparent section T2 of the recording medium T is located between the light emitting unit 73*a* and the light receiving unit 73*b* hidden under the non-transparent section T2. Therefore, the light is blocked by the non-transparent section T2.

In FIG. 6, the developing devices 10Y, 10M, 10C, and 10K adopt the same two-component development system. Only colors of toners used therein are different. Developers including toners and magnetic carriers are stored in the developing devices 10Y, 10M, 10C, and 10K. Each of the developing devices 10Y, 10M, 10C, and 10K includes a developing roller opposed to each of the photosensitive drums 11Y, 11M, 11C, and 11K (collectively, "photosensitive drum 11"), a screw that carries and agitates the developer, and a toner density sensor. The developing roller includes a rotatable sleeve on the outer side and a magnet fixed on the inner side. The toner is supplied from a toner supply device according to an output of the toner density sensor.

Actions and effects of the image forming apparatus according to the first embodiment are explained below. At the time of image formation, a predetermined voltage is applied to a charging roller from a power supply. The charging roller charges the surface of the photosensitive drum 11 opposed to the charging roller. The optical writing unit 3 irradiates a laser beam based on image data on the surface of the photosensitive drum 11 charged at a predetermined potential to write an electrostatic latent image thereon. When the surface of the photosensitive drum 11 carrying the electrostatic latent image reaches the developing device, a toner is supplied to the electrostatic latent image on the surface of the photosensitive drum 11 by the developing roller arranged to be opposed to the photosensitive drum 11. As a result, a toner image is formed on the surface.

The operation described above is applied to all the photosensitive units 2Y, 2M, 2C, and 2K in the same manner at predetermined timing. Toner images of predetermined colors are formed on the surfaces of the photosensitive drums 11Y, 11M, 11C, and 11K, respectively. The recording medium T is conveyed from the sheet feeding cassette 4*a* or 4*b* or the manual feed tray MF. When the recording medium T reaches the nip section 5*a* of the registration rollers 5, the recording medium T temporarily stops (FIGS. 1 and 2). The registration rollers 5 forwards the recording medium T at timing coinciding with image forming operations of the photosensitive units 2Y, 2M, 2C, and 2K. When the recording medium T is forwarded by the registration rollers 5, the boundary T3 between the transparent section T1 and the non-transparent section T2 of the recording medium T is detected by the boundary sensor 73. When the transparent section T1 of the recording medium T is located between the light emitting unit 73*a* and the light receiving unit 73*b*, the light receiving unit 73*b* is receiving light from the light emitting unit 73*a* (FIG. 3). When the recording medium T is further conveyed downstream in the conveying direction, the non-transparent section T2 is located between the light emitting unit 73*a* and the light receiving unit 73*b*. Then, light from the light emitting unit 73*a* is blocked by the non-transparent section T2 (FIG. 4). The control unit senses a light reception signal in the light receiving unit 73*b* and detects the boundary T3 between the transparent section T1 and the non-transparent section T2 of the recording medium T. The control unit performs an image forming operation with the signal received by the light receiving unit 73*b* as a writing trigger.

The toner images on the respective photosensitive drums 11Y, 11M, 11C, and 11K are transferred onto the recording medium T, which has passed the registration rollers 5, one after another while the recording medium T is conveyed by the transfer conveyor belt 60. The transfer conveyor belt 60 transfers the toner images onto the recording medium T according to application of a voltage, which has a polarity opposite to that of the toners on the photosensitive drums 11Y, 11M, 11C, and 11K, from the power supply to primary transfer rollers 67Y, 67M, 67C, and 67K. The primary transfer rollers 67Y, 67M, 67C, and 67K are arranged to be opposed to the photosensitive drums 11Y, 11M, 11C, and 11K across the transfer conveyor belt 60.

When the recording medium T passes a position where the primary transfer roller 67K and the photosensitive drum 11K opposed to each other, the toner images of the four colors are superimposed one on top of another on the recording medium T. Subsequently, the recording medium T is conveyed to the fixing unit 7 and an image 9 is fixed by heat and pressure. In a usual image forming operation, after passing the fixing unit 7, the recording medium T is discharged to the sheet discharge tray 8 through a recording-medium conveyance path indicated by an arrow B in FIG. 6. However, at the time of photographic image output according to the first embodiment, a branching pawl G is switched to change the recording-medium conveyance path to a direction of an arrow C and discharge the recording medium T to the outside of the image forming apparatus. The recording medium T discharged is folded along the boundary T3 to superimpose the transparent section T1 and the non-transparent section T2 one on top of the other. Consequently, it is possible to treat the image 9 as a photographic image.

As described above, according to the first embodiment, the boundary sensor 73 is provided in the position on the downstream side in the recording medium T conveying direction of the registration rollers 5. Thus, it is possible to accurately detect the boundary T3 between the transparent section T1 and the non-transparent section T2 with little difference in an amount of sag and few errors in an amount of biting and the like. Therefore, it is possible to highly accurately form the image 9 in a target position of the transparent section T1 of the recording medium T by using ON/OFF signals received by the light receiving unit 73*b* as a writing trigger for an image forming unit.

Since the non-transparent section T2 of the recording medium T is white, when the recording medium T is folded along the boundary T3 to superimpose the transparent section T1 and the non-transparent section T2 one on top of the other, it is possible to obtain the image 9 excellent in color reproducibility.

Figure 7A:
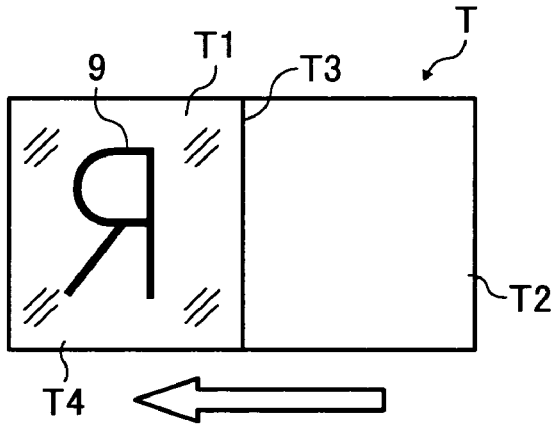
FIG. 7A is a plan view of a state in which a horizontally reversed image is formed in a transparent section of a recording medium according to a second embodiment of the present invention.
Figure 7B:
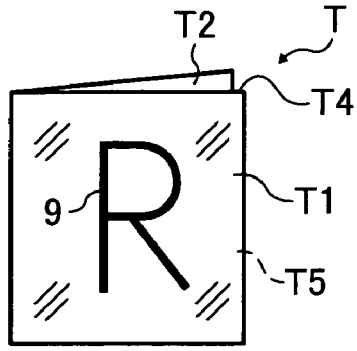
FIG. 7B is a perspective view of the transparent section and a non-transparent section superimposed one on top of the other after image formation according to the second embodiment.
Figure 8A:
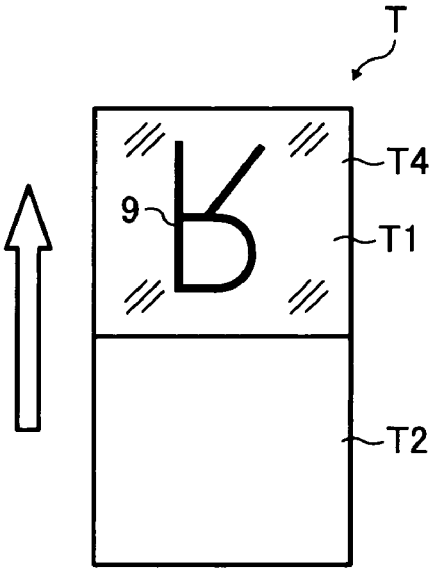
FIG. 8A is a plan view of a state in which a vertically reversed image is formed in the transparent section of the recording medium according to the second embodiment.
Figure 8B:
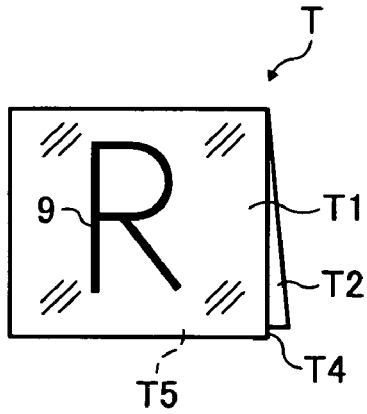
FIG. 8B is a perspective view of the transparent section and the non-transparent section superimposed one on top of the other according to the second embodiment

In the following explanation of a second embodiment of the present invention, components that realize actions and effects identical with those in the first embodiment are denoted by the identical reference numerals and signs. Detailed explanations of the components are omitted. Differences from the first embodiment are mainly explained. FIG. 7A is a plan view of a state in which a horizontally reversed image is formed in a transparent section of a recording medium according to the second embodiment. FIG. 7B is a perspective view of the transparent section and a non-transparent section of the recording medium superimposed one on top of the other after image formation according to the second embodiment. FIG. 8A is a plan view of a state in which a vertically reversed image is formed in the transparent section of the recording medium according to the second embodiment. FIG. 8B is a perspective view of the transparent section and the non-transparent section superimposed one on top of the other according to the second embodiment.

In the second embodiment, the image 9 obtained by horizontally reversing an original image is formed on the front surface T4 of the transparent section T1 of the recording medium T as shown in FIGS. 7A and 7B or the image 9 obtained by vertically reversing the original image is formed on the front surface T4 as shown in FIGS. 8A and 8B. In forming such a reversed image, the control unit subjects image data read by a reading device to reversal processing. The optical writing unit 3 writes the image data after the reversal processing on a photosensitive member as an electrostatic latent image. A reversed image is transferred onto the recording medium T to form an image in the transparent section T1 (FIGS. 7A and 8A).

The image 9 obtained by horizontally or vertically reversing the original image is formed on the front surface T4 of the transparent section T1 of the recording medium T as described above. Consequently, when the recording medium T is folded along the boundary T3 to superimpose the transparent section T1 and the non-transparent section T2 one on top of the other, it is possible to obtain a normal non-reversed image viewed from a non-image surface (the rear surface) T5 of the recording medium T.

It is possible to perform the folding processing for the recording medium T using a folding processing unit of a post-processing device provided next to the image forming apparatus 100.

As described above, according to the second embodiment, it is possible to fold the recording medium T along the boundary T3 between the transparent section T1 and the non-transparent section T2 to superimpose the transparent section T1 and the non-transparent section T2 one on top of the other. Thus, for example, sheet feeding work is easier compared with work for separately feeding a transparent recording medium and a non-transparent recording medium. Moreover, a structure required for superimposing the transparent recording medium and the non-transparent recording medium one on top of the other is unnecessary.

Other than simply folding the transparent section T1 and the non-transparent section T2 to superimpose the sections one on top of the other, the transparent section T1 and the non-transparent section T2 may be bonded after being folded and superimposed one on top of the other. In this case, since the image formation surface is covered with the transparent section T1, the image formation surface is not directly exposed to the outside. This makes it possible to maintain a high-quality image.

Figure 9A:
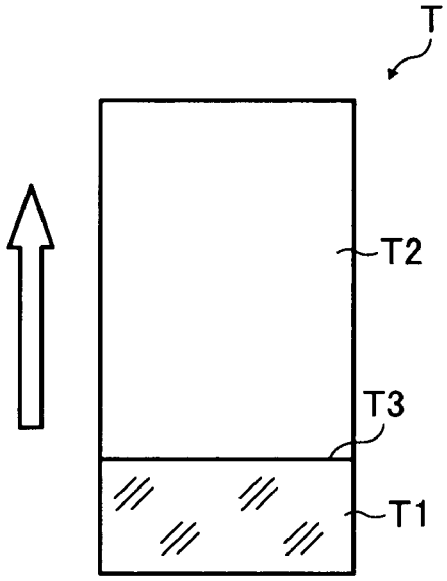
FIGS. 9A and 9B are plan views of a recording medium with areas of a transparent section and a non-transparent section not equally divided according to a third embodiment of the present invention.
Figure 9B:
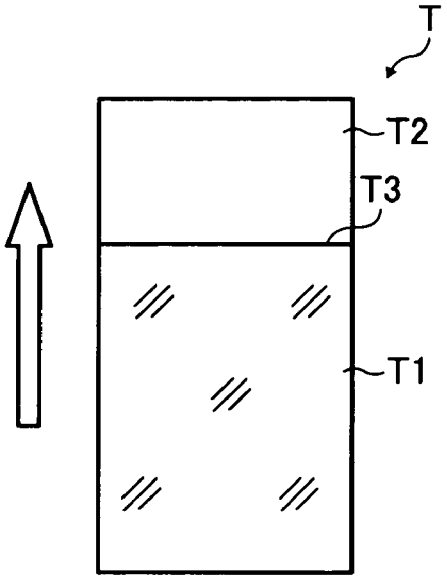

FIGS. 9A and 9B are plan views of the recording medium T with areas of the transparent section T1 and the non-transparent section T2 not equally divided according to a third embodiment of the present invention. In the third embodiment, in an example shown in FIG. 9A, an area of the transparent section T1 of the recording medium T is set to be equal to or smaller than a half of an area of the entire recording medium T. In an example shown in FIG. 9B, an area of the transparent section T1 of the recording medium T is set to be equal to or larger than a half of the area of the entire recording medium T. In this case, the boundary T3 between the transparent section T1 and the non-transparent section T2 is formed in a direction (an arrow direction) orthogonal to the conveying direction of the recording medium T to allow the boundary sensor 73 to detect the boundary T3 between the transparent section T1 and the non-transparent section T2.

As described above, according to the third embodiment, it is possible to freely change an area of the transparent section T1 of the recording medium T. Moreover, it is possible to use the recording medium T for various applications by forming the transparent section T1 large or forming the non-transparent section T2 large. Therefore, convenience of use of the recording medium T is satisfactory.

Figure 10A:
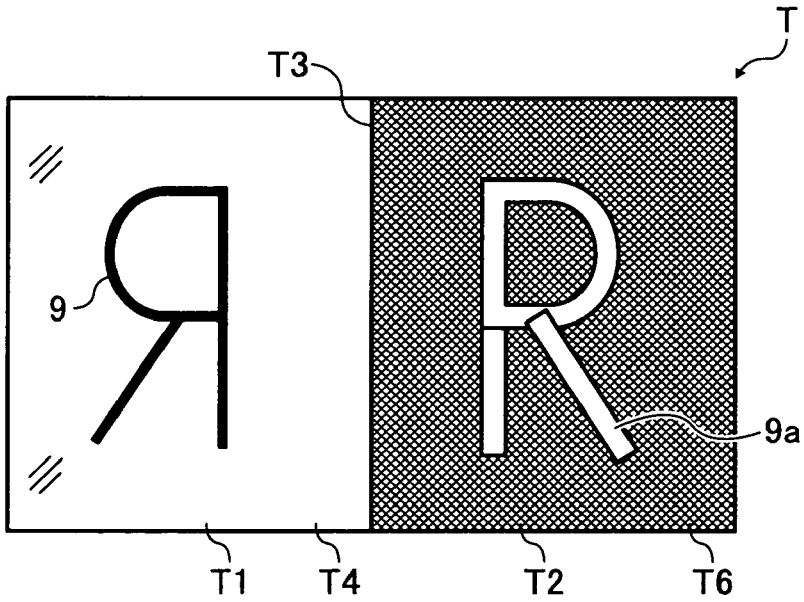
FIGS. 10A and 10B are plan views of formation of a reversed image in a transparent section of a recording medium and formation of a void image of an original image in a non-transparent section of the recording medium according to a fourth embodiment of the present invention.
Figure 10B:
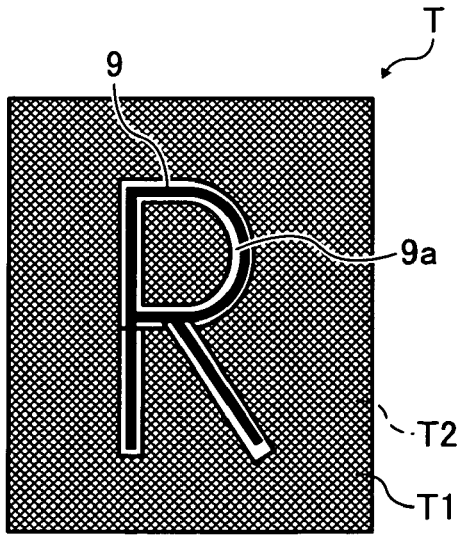

FIGS. 10A and 10B are plan views of formation of a reversed image in a transparent section of a recording medium and formation of a void image of an original image in a non-transparent section of the recording medium according to a fourth embodiment of the present invention. In the fourth embodiment, as shown in FIG. 10A, the reversed image 9 is formed in the transparent section T1 of the recording medium T and an image 9*a* obtained by making an original image void is formed in the non-transparent section T2. In this case, it is possible to accurately control image formation positions of the reversed image 9 and the void image 9*a*, respectively, by detecting the boundary T3 between the transparent section T1 and the non-transparent section T2.

As described above, according to the fourth embodiment, as shown in FIG. 9B, when the recording medium T is folded along the boundary T3 to superimpose the transparent section T1 and the non-transparent section T2 one on top of the other, the image 9 and the void image 9*a* overlap each other to improve a decorative effect.

Figure 11:
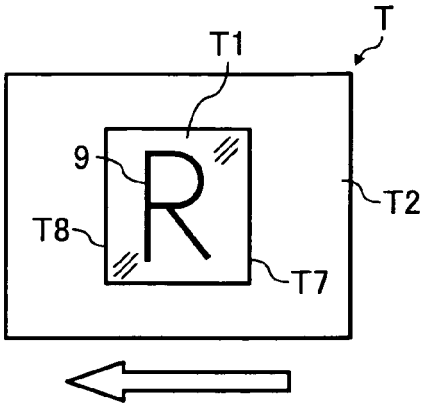
FIG. 11 is a plan view of a recording medium including a non-transparent section provided in a position surrounding a transparent section, in which an image is formed, according to a fifth embodiment of the present invention.

FIG. 11 is a diagram of a recording medium including a non-transparent section provided in a position surrounding a transparent section, in which an image is formed, according to a fifth embodiment of the present invention. In the fifth embodiment, the non-transparent section T2 is provided in a position surrounding the transparent section T1 in which the image 9 is formed. A leading edge T8 and a trailing end T7 in the recording medium conveying direction of the transparent section T1 is detected using the boundary sensor 73.

As described above, according to the fifth embodiment, even when the transparent section T1 is provided in an arbitrary position in the recording medium T, it is possible to detect the leading edge T8 and the trailing end T7 in the recording medium T conveying direction, which form boundaries between the transparent section T1 and the non-transparent section T2, using the boundary sensor 73 (not shown in FIG. 11) and form the image 9 in a target position of the transparent section T1.

Figure 12:
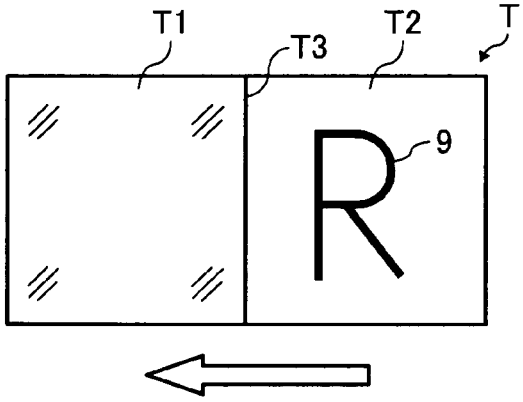
FIG. 12 is a plan view of image formation in a non-transparent section of a recording medium according to a sixth embodiment of the present invention.

FIG. 12 is a plan view of image formation in a non-transparent section of a recording medium according to a sixth embodiment of the present invention. In the sixth embodiment, the image 9 is formed in the non-transparent section T2 of the recording medium T.

According to the sixth embodiment, even when the image 9 is formed in the non-transparent section T2, it is possible to detect the boundary T3 between the transparent section T1 and the non-transparent section T2 using the boundary sensor 73 (not shown in FIG. 12) and form the image 9 in a target position of the non-transparent section T2.

Figure 13:
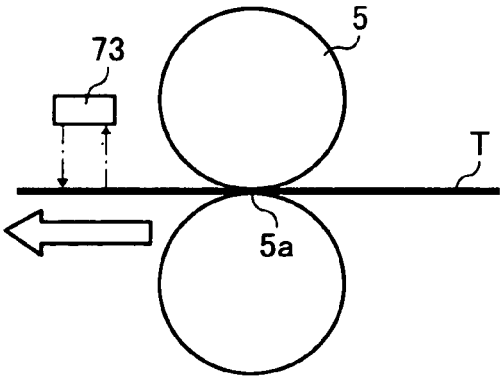
FIG. 13 is an enlarged sectional view of a main part of a sheet feeding device according to a seventh embodiment of the present invention.

FIG. 13 is an enlarged sectional view of a main part of a sheet feeding device according to a seventh embodiment of the present invention. In the seventh embodiment, a photosensor that uses reflected light is provided as the boundary sensor 73 on the downstream side of conveyance of the recording medium T through the nip section 5*a* of the registration rollers 5.

According to the seventh embodiment, it is possible to, making use of a difference between reflectance of the transparent section T1 and reflectance of the non-transparent section T2, detect the boundary T3 between the transparent section T1 and the non-transparent section T2 using the reflected light photosensor. Since it is possible to use the reflected light photosensor, choices of a photosensor are widened. This makes it possible to design a highly-accurate and highly-efficient sheet feeding device.

Embodiments of the present invention are not limited to the first to the seventh embodiments described above. Various modifications of the embodiments are possible without departing from the spirit of the present invention. In the first to the third embodiment, the non-transparent section T2 of the recording medium T is white. However, when a monotone image is outputted instead of a full-color photograph image, the non-transparent section T2 is not limited to white.

Figure 14:
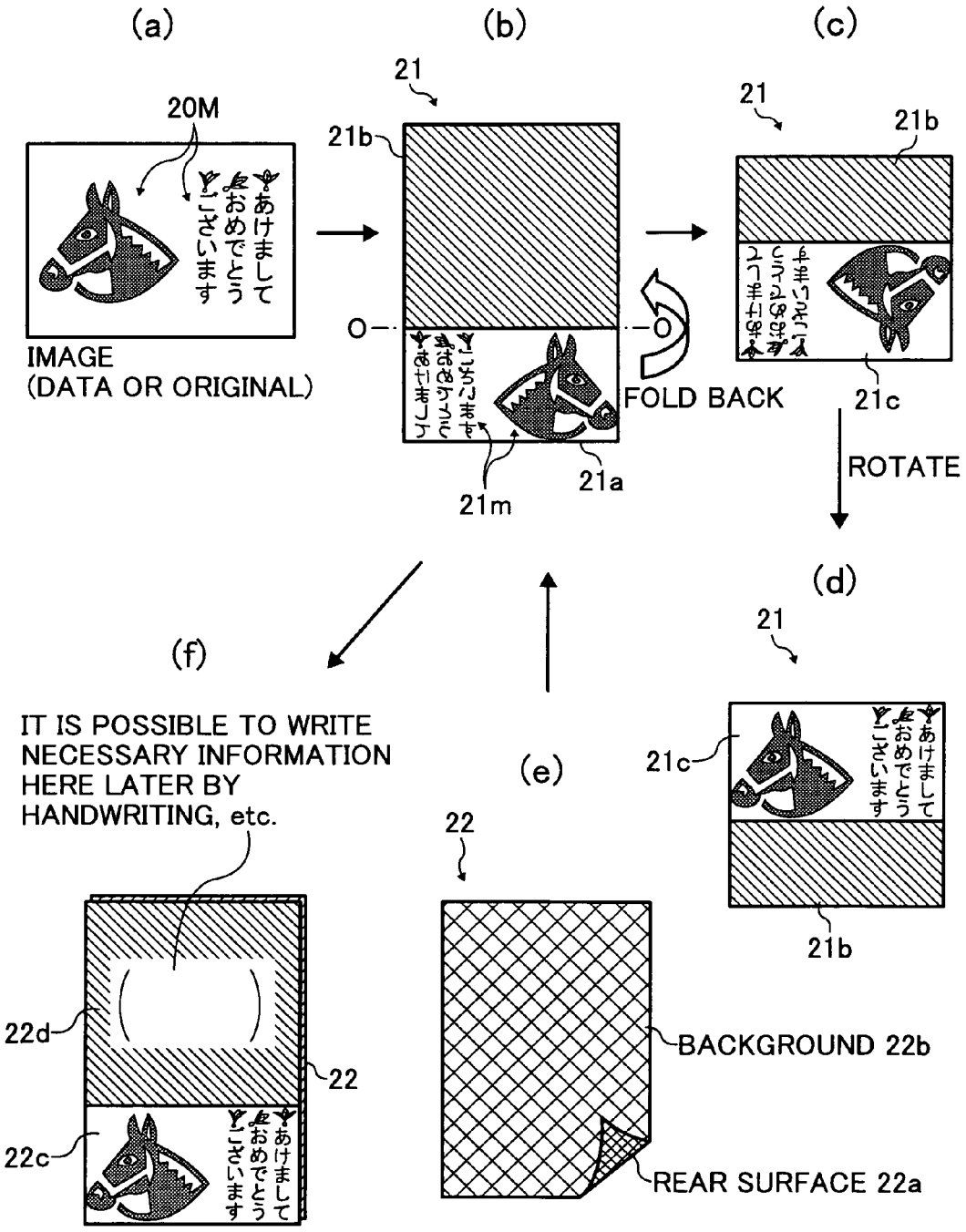
FIG. 14 is a schematic diagram for explaining a procedure for forming a glossy image from a color original image including characters and illustrations according to an eighth embodiment of the present invention.

FIG. 14 is a schematic diagram for explaining a procedure for creating a glossy image from a color original image including characters and illustrations according to an eighth embodiment of the present invention. In the eighth embodiment, a New Year's card with a glossy image is created. An original image 20M including characters and an illustration is indicated by (a) shown in FIG. 14. An original image may be an image shown in an original or data stored in storing means such as a hard disk.

For example, as indicated by (b) shown in FIG. 14, a recording image (a toner image) 20*m* is formed on a recording medium 21, which is a sheet-like medium, using an image forming apparatus described later. The recording medium 21 includes a transparent section 21*a* and a non-transparent section 21*b* that can be folded back. In this example, an area of the transparent section 21*a* is smaller than an area of the non-transparent section 21*b*. A portion where the recording image 20*m* is formed is a surface on a side of the transparent section 21*a* that overlaps the non-transparent section 21*b* (functioning as an overlapping medium) when the transparent section 21*a* is folded back. In other words, an image formation surface of the transparent section 21*a* is backed by the non-transparent section 21*b*. A form of an image in the transparent section 21*a* is a mirror image obtained by reversing the front and the back of the original image 20M.

It is possible to enlarge and reduce the image with respect to the original image 20M as required. When original data is a mirror image, the mirror image itself is formed in the transparent section 21*a*. A color, a pattern, and the like of the non-transparent section 21*b* on the same surface as the recording image 20*m* affect a background of a finished image when an adhesive described later is transparent. Thus, the non-transparent section 21*b* is designed as appropriate taking that point into account.

The transparent section 21*a* is folded back along a boundary O-O between the transparent section 21*a* and the non-transparent section 21*b* with the image formation surface, on which the recording image 20*m* is formed, set on the inner side thereof. In folding back the transparent section 21*a*, an adhesive is applied to an area overlapping the transparent section 21*a* (or the image formation surface) on the upper surface of the non-transparent section 21*b* in advance.

When a layer of the adhesive is not colorless and transparent, the adhesive layer forms a background of a finished image. When the adhesive layer is colorless and transparent, the non-transparent section 21*b* forms a background of a finished image. If the non-transparent section 21*b* is reflected on a background of a finished image, it is advisable to make the adhesive layer transparent. If a background of a finished image is set regardless of a color, a pattern, and the like of the non-transparent section 21*b*, the adhesive layer only has to be made non-transparent. It is considered that, if the adhesive always has a general white color as a background color, it is possible to cope with various images in many cases.

The non-transparent section 21*b* passes a fixing roller unit or is conveyed by a conveying roller in the image formation process together with the transparent section 21*a*. Thus, if the adhesive is applied to the non-transparent section 21*b* and exposed from the beginning, the adhesive sticks to the conveying roller. This is unsuitable for conveyance in the image forming apparatus. Thus, the adhesive only has to be applied to the non-transparent section 21*b* when the non-transparent section 21*b* is superimposed on the transparent section 21*a* after the recording medium 21 passes through the image forming apparatus. Alternatively, when the adhesive is applied to the non-transparent section 21*b* in advance, a heat-resistance seal only has to be stuck to the surface of the adhesive to protect the adhesive when the non-transparent section 21*b* passes a heat fixing unit and peeled off when the non-transparent section 21*b* is superimposed on the transparent section 21*a*. Moreover, it is also possible to use a heat-sensitive adhesive and impart adhesion to the adhesive after the non-transparent section 21*b* passes the heat fixing unit at a final step.

The transparent section 21*a* is integrated with the non-transparent section 21*b* via the adhesive by folding back the transparent section 21*a*. In this example, since the area of the transparent section 21*a* is smaller than that of the non-transparent section 21*b*, as indicated by (c) shown in FIG. 14, an overlapping section 21*c* that overlaps the transparent section 21*a* folded back and a blank section 21*d* are formed in the non-transparent section 21*b*. In other words, the non-transparent section 21*b* also serves as an overlapping medium. In the overlapping section 21*c*, it is possible to see an image that is the same as an original image (an image that is not a mirror image) through the transparent section 21*a*. It is seen that, since the image indicated by (c) is upside down, a normal image indicated by (d) shown in FIG. 14 is obtained if the recording medium 21 is vertically reversed. It is possible use the blank section 21*d* as a space in which a message or the like is handwritten.

Figure 15:
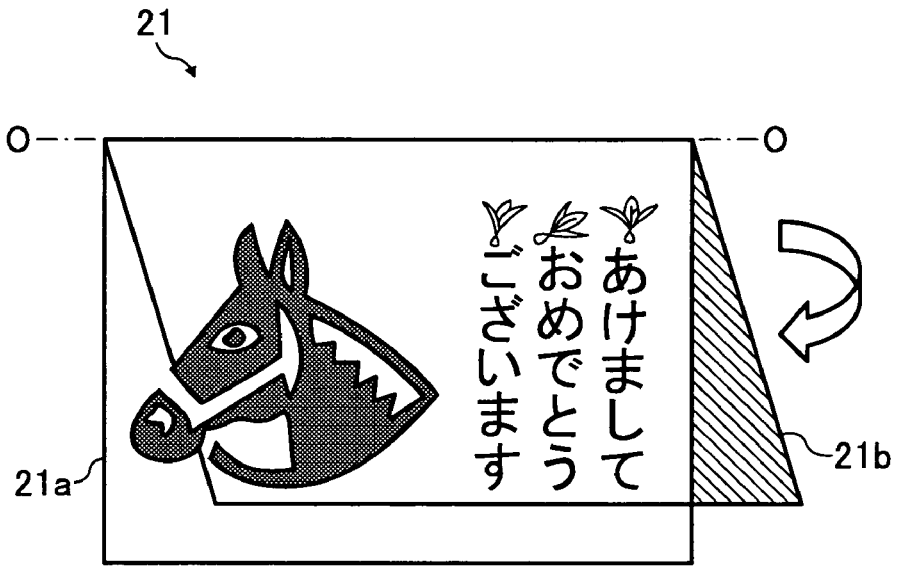
FIG. 15 is a diagram of a state of creation of a transparent section and a non-transparent section of a recording medium equally divided according to the eighth embodiment.

FIG. 15 is a diagram of a state of creation of a transparent section and a non-transparent section of a recording medium equally divided according to the eighth embodiment. In FIG. 15, the boundary O-O between the transparent section 21*a* and the non-transparent section 21*b* is in a position for equally dividing the transparent section 21*a* and the non-transparent section 21*b* rather than the position for normally dividing the transparent section 21*a* and the non-transparent section 21*b* indicated by (b) shown in FIG. 14. In this case, after the transparent section 21*a* is folded back and integrated with the non-transparent section 21*b* via the adhesive, the recording medium 21 serves as an image recording medium, on which only an image is formed without a blank for handwriting information.

As described above, according to the eighth embodiment, after an image is outputted to the image recording medium, an arbitrary folding-back section located in a boundary between the transparent section 21*a* and the non-transparent section 21*b* is folded back to integrate the transparent section 21*a* and the non-transparent section 21*b* via the adhesive. This makes it possible to easily obtain a highly glossy photograph image. It is also possible to easily realize creation of a blank section for handwriting a message or the like.

A ninth embodiment of the present invention is explained. The ninth embodiment is the same as the eighth embodiment up to the process for forming the recording image 20*m* based on the original image 20M in the transparent section 21*a* of the recording medium 21 as indicated by (b) shown in FIG. 14. In the ninth embodiment, subsequently, a sheet-like overlapping medium 22 having the same size as the recording medium 21 is prepared as indicated by (e) shown in FIG. 14. One side 22*a* of the overlapping medium 22 is a surface to be the back of an image recording medium finally manufactured. Other side 22*b* is a surface that could be a background of the recording image 20*m*. A white or transparent adhesive layer is formed on the other side 22*b* or the image formation surface of the recording medium 21.

The overlapping medium 22 indicated by (e) shown in FIG. 14 is superimposed on the recording medium 21 such that the other side 22*b* is opposed to the recording image 20*m* indicated by (b) shown in FIG. 14. Consequently, the overlapping member 22 is integrated with the recording medium 21 via the adhesive layer. If this integrated sheet is turned over, as indicated by (f) shown in FIG. 14, an image recording medium having a glossy image is manufactured as in the eighth embodiment. In other words, in an overlapping section 22*c*, it is possible to see a correct image that is the same as the original image (an image that is not a mirror image) through the transparent section 21*a*. The rear surface of the non-transparent section 21*b* indicated by (b) shown in FIG. 14 is a blank section 22*d* indicated by (f) shown in FIG. 14. It is possible to write necessary information in the blank section 22*d* later by handwriting or the like.

As described above, according to the ninth embodiment, the one side 22*a* of the overlapping medium 22 having the same size as the recording medium 21 is a surface to be the back of an image recording medium finally manufactured. The overlapping medium 22 is integrated with the recording medium 21 via the adhesive without folding back the image recording medium. This makes it possible to easily obtain a highly glossy photograph image.

A cross section of the image recording medium manufactured as described above is shown in FIG. 16. The transparent section 21*a* and the non-transparent section 21*b* (the overlapping medium 22) are integrated via the adhesive layer. The recording image 20*m* is covered with the transparent section 21*a*. Thus, a storage life of the image is satisfactory. Since the surface of the transparent section 21*a* has glossiness, it is possible to look at the image as a photographic glossy image.

Figure 16:
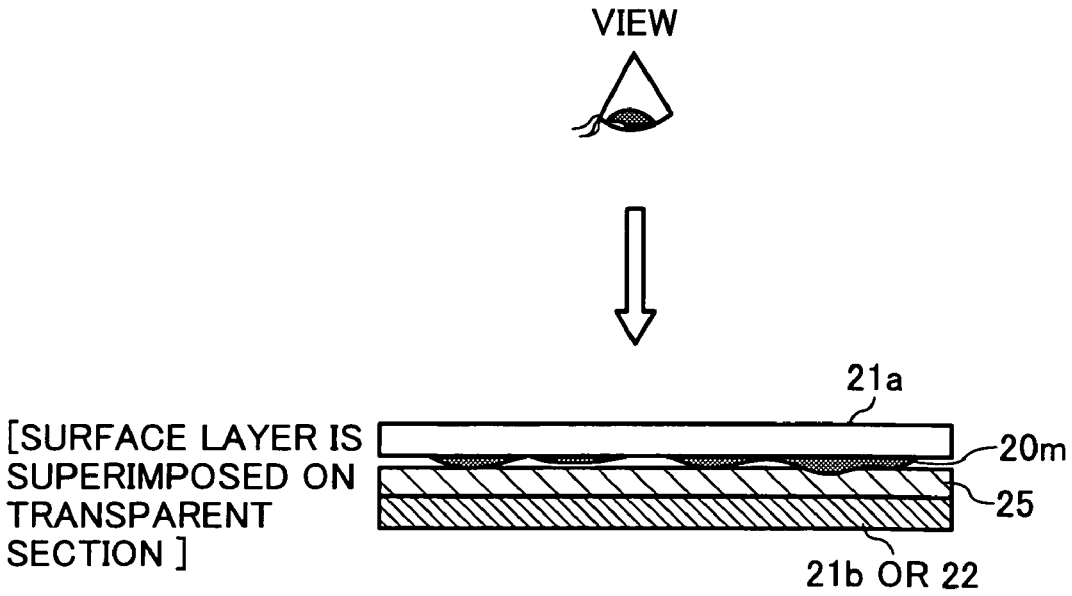
FIG. 16 is a diagram of a state of observation through a transparent section of an image recording medium according to first to ninth embodiments of the present invention.
Figure 17A:
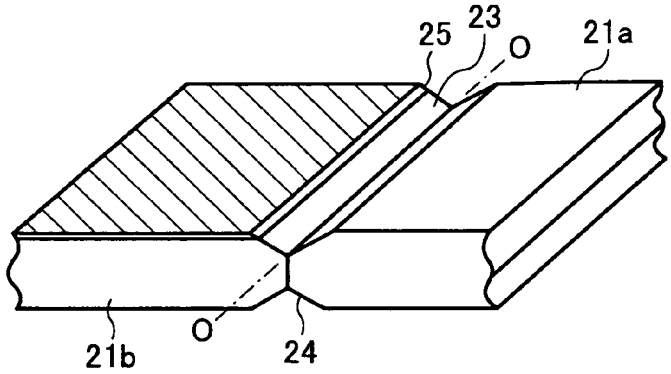
FIGS. 17A to 17C are diagrams of glossy image formation performed by folding back a recording medium provided with a linear concave section according to the eighth embodiment.
Figure 17B:
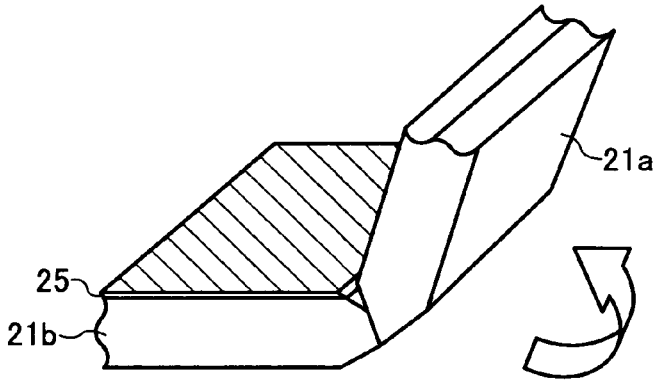
Figure 17C:
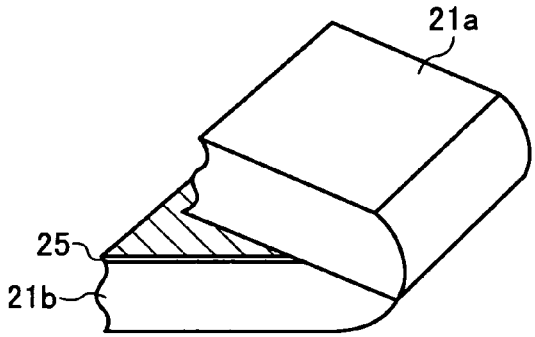

FIG. 16 is a diagram of a state of observation through the transparent section 21*a* of the image recording medium according to the first to the ninth embodiments. In the eighth embodiment, a portion where the transparent section 21*a* is folded back is set as the boundary O-O between the transparent section 21*a* and the non-transparent section 21*b* in the recording medium 21. Consequently, as shown in FIG. 16, it is possible to display an image in the transparent section 21*a* as a glossy image satisfactorily. In FIG. 16, a surface layer 25 is formed on the non-transparent section 21*b* and superimposed on the transparent section 21*a* with the recording image 20*m* formed on the transparent section 21*a*. It is advisable to form, as means for neatly folding back the transparent section 21*a*, a linear concave section (see FIGS. 17A to 17C) in the recording medium 21 along the boundary O-O. FIGS. 17A to 17C are diagrams of glossy image formation performed by folding back a recording medium provided with a linear concave section according to the eighth embodiment.

In FIG. 17A, concave lines 23 and 24 of a V shape in section are formed on both sides in the thickness direction (the vertical direction in the figure) in the boundary O-O to be opposed to each other. A concave line may be formed only on one side in the thickness direction in the boundary O-O. On the left side of the boundary O-O in the figure, the non-transparent section 21*b* and the surface layer 25 are formed. On the right side, the transparent section 21*a* is formed. By forming such concave sections, a folding-back section is specified and folding-back is easily performed. Thus, it is possible to neatly fold back the transparent section 21*a* in an order shown in FIGS. 17A, 17B, and 17C. The same advantage is obtained by forming perforations instead of forming the concave sections.

Figure 18:
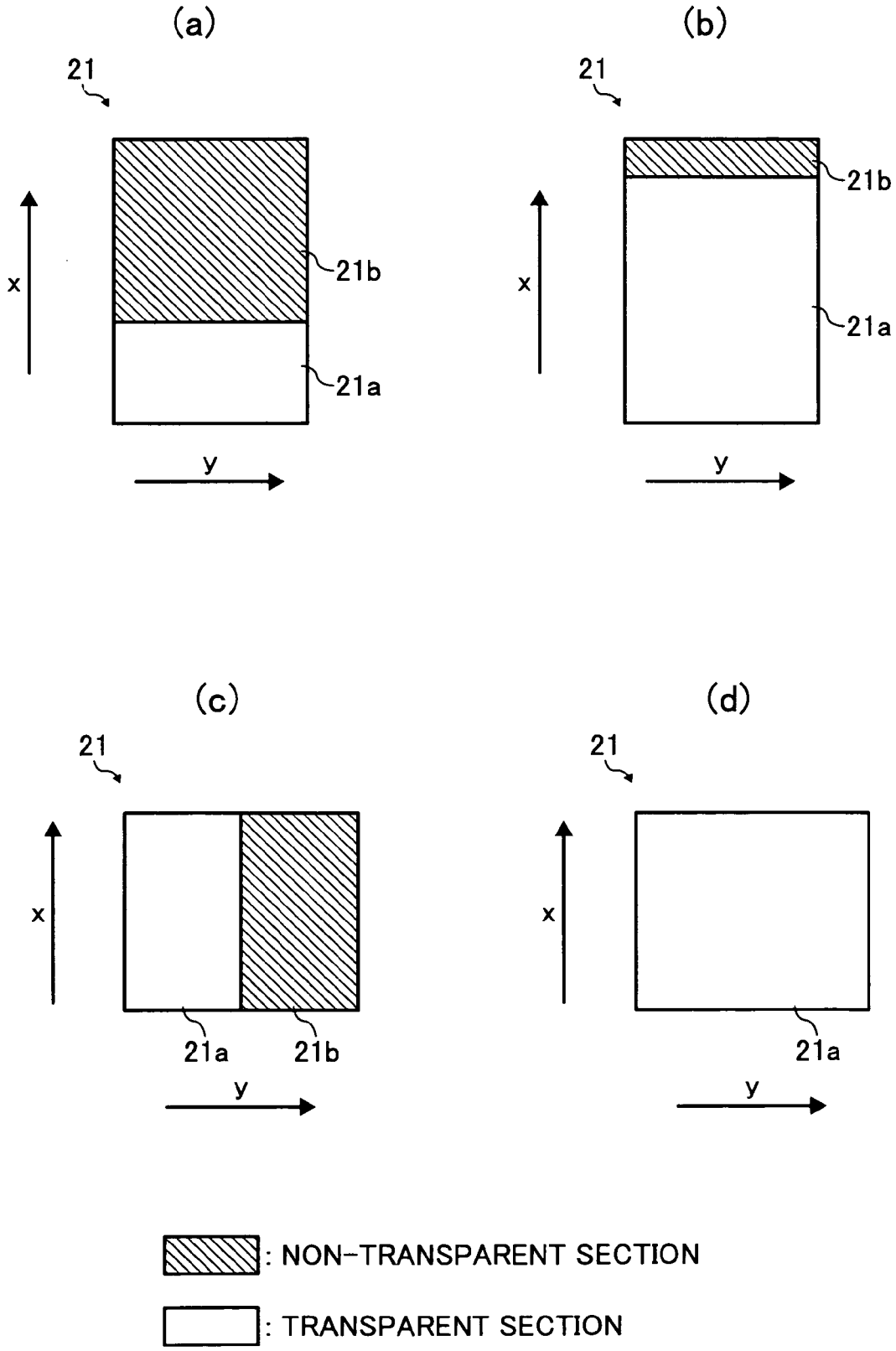
FIG. 18 is a schematic diagram for explaining various examples of a recording medium including a transparent section and a non-transparent section at different ratios according to a tenth embodiment of the present invention.

In the first to the ninth embodiments, in the image forming apparatus shown in FIG. 6, a recording medium having a transparent section at least in a part thereof as shown in FIG. 18 is used as a transfer sheet T. An image corresponding to an original image is written on the photosensitive drum 11 by light from the optical writing unit 3, developed with a color toner, and transferred onto the transparent section of the recording medium. The recording medium is discharged to the sheet discharge tray 8. The writing of the image by the optical writing unit 3 is performed to form an image reversed from the original image in the transparent section 21*a* of the recording medium 21. It is possible to input original image data from an external apparatus connected to the image forming apparatus. Alternatively, it is possible to use image information read by a not-shown scanner incidental to the image forming apparatus.

FIG. 18 is a schematic diagram for explaining various examples of a recording medium including a transparent section and a non-transparent section at different ratios according to a tenth embodiment of the present invention. Like the recording medium 21 indicated by (a) shown in FIG. 18, in the recording medium 21 shown in FIG. 18, the transparent section 21*a* is smaller than the non-transparent section 21*b*. In the recording medium 21 indicated by (b) shown in FIG. 18, the transparent section 21*a* is larger than the non-transparent section 21*b*. In the recording medium indicated by (c) shown in FIG. 18, the transparent section 21*a* and the non-transparent section 21*b* have the same size. The entire recording medium 21 indicated by (d) shown in FIG. 18 is the transparent section 21*a*. A conveying direction of the recording medium 21 may be an x direction or a y direction.

In an image forming apparatus, a condition that these recording media having transparent sections at least in a part thereof are conveyed through the image forming apparatus is set. As a method of setting the condition, there are, for example, a method in which a user instructs the image forming apparatus to convey the recording media in a setting of sheet feeding means (the sheet feeding cassette 4*a*) in advance and a method in which the user registers a transparent area (the transparent section 21*a*) of a specific size in a control unit of the image forming apparatus in advance.

After a transparent section is decided, when it is judged that an image is formed at least in the transparent section decided, the image forming apparatus automatically forms an image reversely. As a result, a reversed image is formed at least in the transparent section 21*a* on the recording medium after passing the fixing unit 7.

It is possible to easily obtain a photographic image by placing the recording medium obtained above on a white overlapping medium with a print surface (an image formation surface) thereof faced downward. Since the print surface (the image formation surface) is faced downward on the white overlapping medium, the print surface is not directly damaged from the outside. Thus, a storage life of the image is satisfactory. The reversed image is formed in the transparent section and an image component (a toner image) adheres to a transparent base material side.

In general, sizes and resolutions of data such as characters and images that can be recorded in the transparent section are not fixed. Therefore, it is extremely complicated to manually adjust images of different sizes to a size of the transparent section one by one and reverse and output the image.

In the tenth embodiment, it is possible to automatically process a series of operations for enlarging or reducing a size of an image to be outputted to a proper size according to an area decided as transparent by the image forming apparatus and applying reversal operation to the image. A difference between the manual work (the conventional technology) and the automatic work (the tenth embodiment) is schematically described below with general image forming means such as a copying machine or a printer as an example.

A: When a reversed image is formed on a recording medium having a transparent section at least in a part thereof by the manual work 1. Selection of an image 2. Change in a size of image data (enlarge and reduce a size of image data taking into account a resolution and a transparent section size)

3. Reversal of image data

4. Alignment of image data (move image data to the transparent section taking into account the non-transparent section)

5. Print instruction

In general, dedicated application software is separately required for the work in 2 and 3 above. Usually, every time image data is changed and every time a condition of the transparent section is changed, adjustment is required.

B. When the series of operation is automatically executed in the tenth embodiment 1. The user instructs the image forming apparatus to execute printing in the transparent section such as "photographic print". It is possible to give this instruction using, for example, a setting button for copying and a setting icon on a printer driver.

2. Selection of an image

3. Print instruction (the image is automatically enlarged or reduced properly to a size of the transparent section and reversed)

Figure 19:
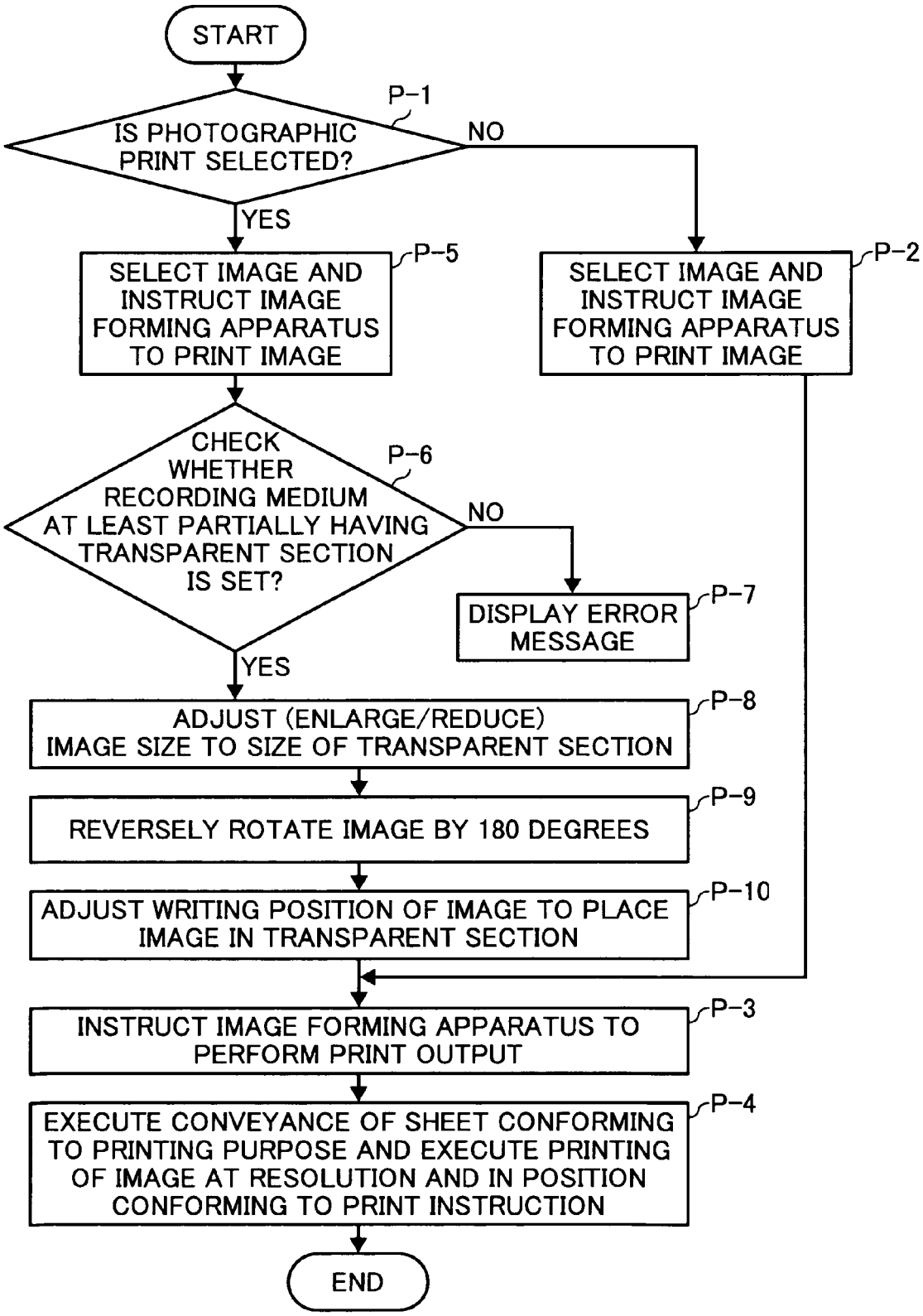
FIG. 19 is a sequence chart of image output control over an image forming apparatus according to the tenth embodiment.

The image formation in the transparent section by the image forming apparatus is executed by a program of the control unit (not-shown) incidental to the image forming apparatus. The image formation is performed in a procedure shown in FIG. 19 including image formation in the transparent section of the recording medium. FIG. 19 is a sequence chart of image output control over the image forming apparatus according to the tenth embodiment. When it is judged at step P-1 that photographic print is not selected, the program proceeds to step P-2. The program selects an image that should be printed and instructs the image forming apparatus to print the image. At step P-3, the program instructs the image forming apparatus to perform print output. At step P-4, the program executes conveyance of a sheet (a recording medium) conforming to a printing purpose and executes printing of the image at a resolution and in a position conforming to the print instruction.

When it is judged at step P-1 that photographic print is selected, the program proceeds to step P-5. The program selects an image that should be printed and instructs the image forming apparatus to print the image. At step P-6, the program checks whether recording media having transparent sections at least in a part thereof are set in a sheet feeding cassette or the like. When the recording media are not set, at step P-7, the program displays an error message. When the recording media are set, the program proceeds to step P-8. The program enlarges or reduces a size of an image to be formed in the transparent section 21*a* to adjust the size to a size of the transparent section.

At step P-9, the program processes image data to form a reversed image in the transparent section 21*a*. At step P-10, the program adjusts an image writing position to place the image in the transparent section 21*a*. Subsequently, the program proceeds to step P-3. At step P-4, the program executes printing of an image at a resolution and in a position conforming to the print instruction.

As described above, according to the tenth embodiment, an image obtained by reversing an original image is formed in the transparent section of the recording medium by the program of the control unit. Finally, a highly glossy photograph image obtained by superimposing the transparent section and the non-transparent section one on top of the other via an adhesive layer is automatically outputted from the image forming apparatus.

Figure 20:
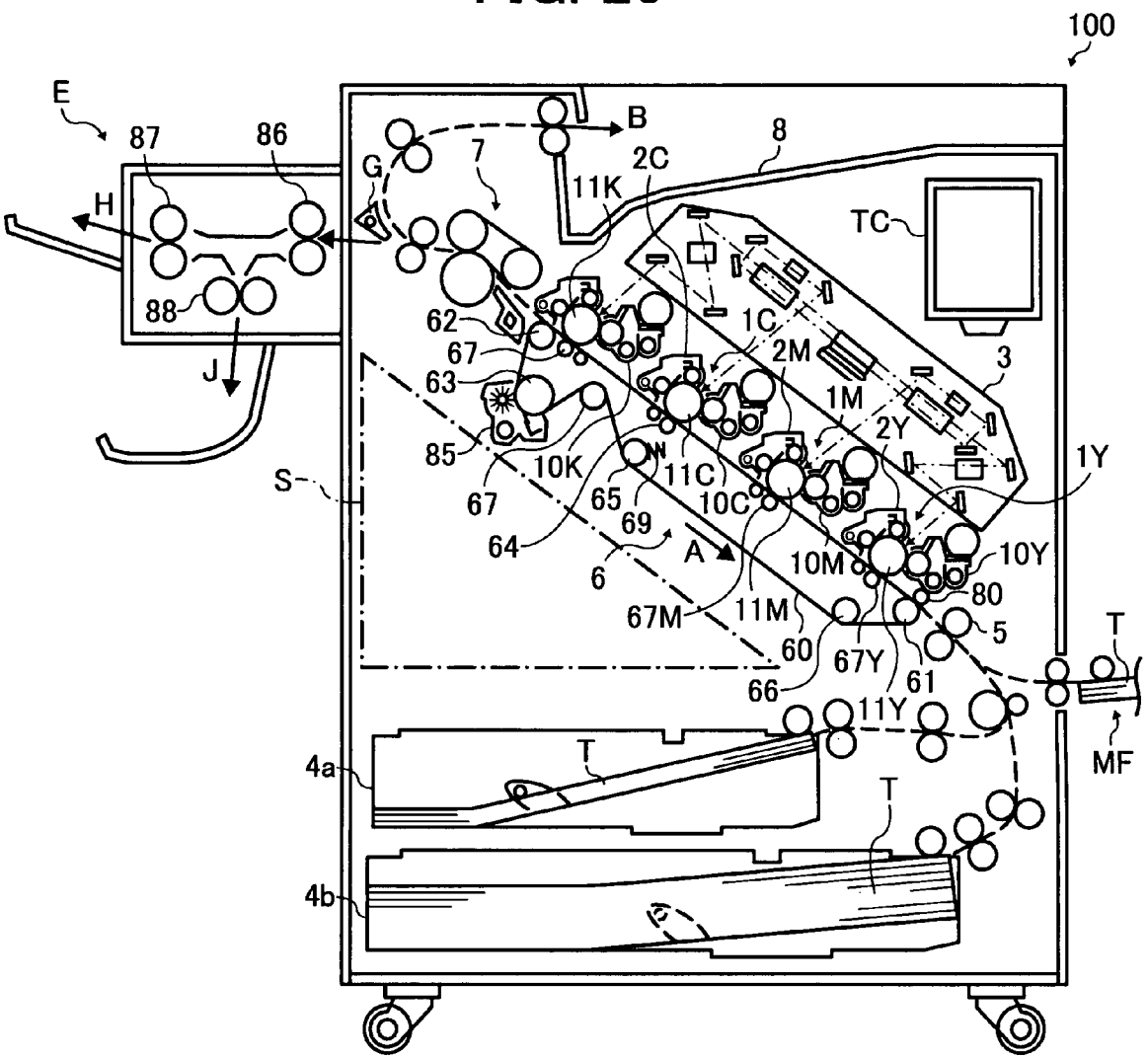
FIG. 20 is an overall diagram of an image forming apparatus having a center folding device is arranged therein according to an eleventh embodiment of the present invention.
Figure 21A:
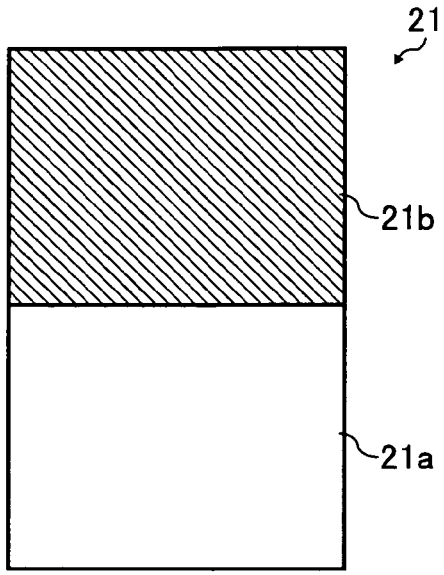
FIGS. 21A and 21B are schematic diagrams of a recording medium used as a transfer sheet in the eleventh embodiment.
Figure 21B:
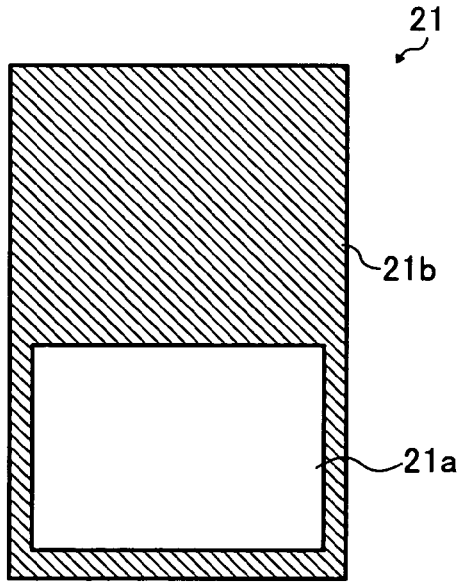

FIG. 20 is an overall diagram of an image forming apparatus in which a center folding device is arranged according to an eleventh embodiment of the present invention. FIGS. 21A and 21B are schematic diagrams of a recording medium used as a transfer sheet in the eleventh embodiment. In the eleventh embodiment, one half of the recording medium 21 shown in FIG. 21A is the non-transparent section 21*b* indicated by a shaded portion and the other half is the transparent section 21*a* indicated by a white portion. As shown in FIG. 21*b*, a part of the recording medium 21 may be the transparent section 21*a* in a white portion. A color of the white portion is not limited to white as long as the portion is non-transparent.

FIG. 22 is a schematic perspective view for explaining details of processing in the center folding device according to the eleventh embodiment. Formation and fixing of an image in the transparent section 21*a* of the recording medium 21 are explained with reference to FIG. 20 and FIGS. 22A to 22E. In this case, an image obtained by mirror-reversing an original image ((a) and (d) shown in FIG. 24) is printed in the transparent section 21*a*. In the eleventh embodiment, image formation on an image recording medium is performed according to operations that are the same as those performed by the image forming apparatus according to the first embodiment. Therefore, the same operations are performed until the recording medium 21 passes the fixing unit 7.

In FIG. 20, after passing the fixing unit 7, the recording medium 21 is conveyed to a post-processing device (in this case, a center folding device E) from the image forming apparatus 100. The branching pawl G is arranged in an appropriate portion behind the fixing device. By switching the branching pawl G, the recording medium 21 is discharged to the sheet discharge tray 8 through a conveyance path B or discharged to the post-processing device E (in a C direction).

In a usual post-processing device, to place sheets forming a printed material including a plurality of pages one on top of another in order, the sheets are reversed before entering the post-processing device. In the eleventh embodiment, by providing a not-shown branching device in a portion for the reversal, it is possible to send sheets to the post-processing device without reversing the sheets. In other words, it is possible to realize a way of folding opposite to a way of using a usual center folding device simply by providing the branching device.

The center folding device is generally used to place a plurality of output sheets one on top of another, staple the center of the sheets, and fold the sheets. For a photographic image having a satisfactory storage fife according to the eleventh embodiment, a folding operation is carried out every time one photographic image is obtained. Thus, a reversing operation is unnecessary.

Figure 22A:
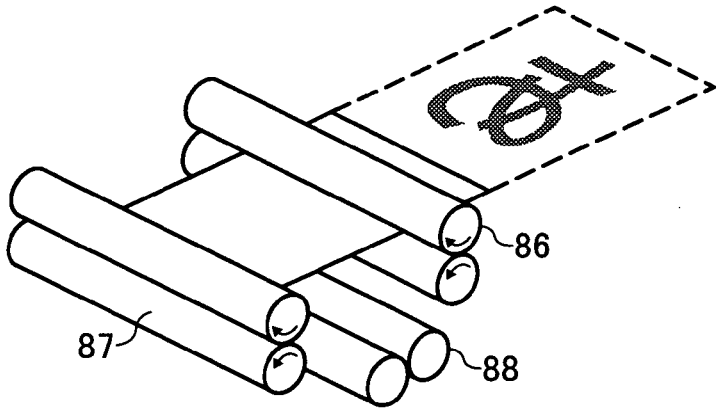
FIGS. 22A to 22E are schematic perspective views for explaining details of processing in the center folding device according to the eleventh embodiment.
Figure 22B:
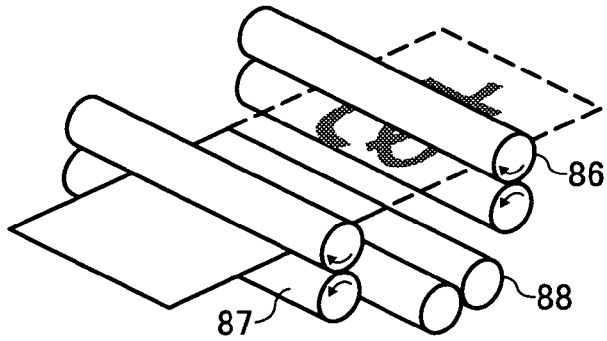

In FIG. 20 and FIGS. 22A to 22E, the center folding device E includes roller pairs 86, 87, and 88. The recording medium 21 shown in FIG. 21A, which is conveyed to the post-processing device (in this case, the center folding device E) from the image forming apparatus 100 after passing the fixing unit 7, is conveyed to the roller pair 87 through the roller pair 86 (FIGS. 22A and 22B).

Figure 22C:
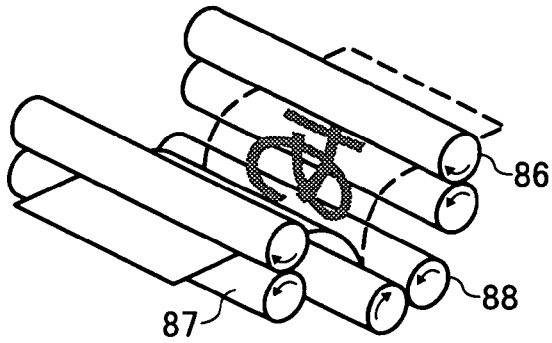
Figure 22D:
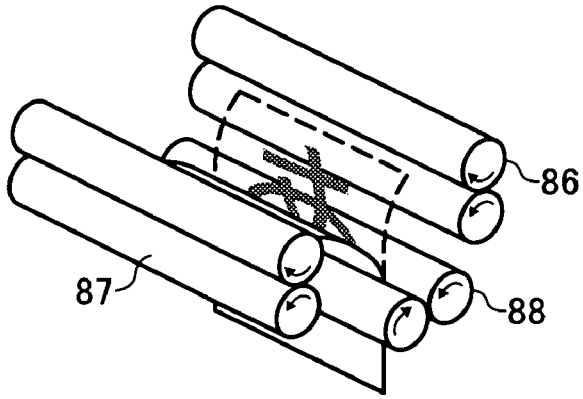
Figure 22E:
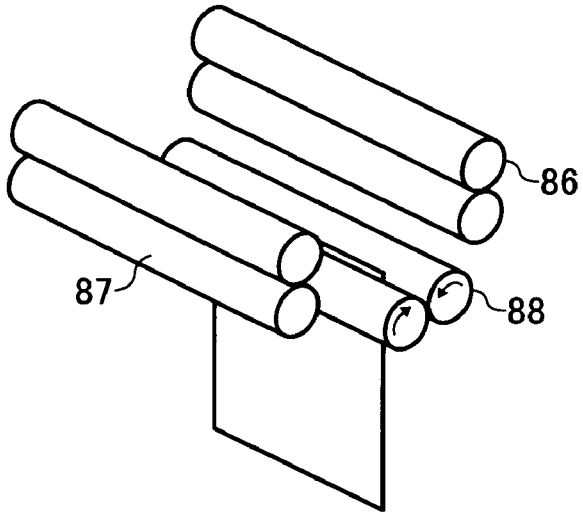

In this case, the leading edge of the recording medium 21 conveyed to the roller pair 87 through the roller pair 86 is temporarily conveyed in an H direction in FIG. 20. When the boundary between the non-transparent section 21*b* and the transparent section 21*a* reaches substantially above the roller pair 88 as shown in FIG. 22C, the roller pair 87 is reversely rotated to cause the recording medium 21 to sag to the roller pair 88 (FIG. 22D). The sagging recording medium 21 is nipped by the roller pair 88 to superimpose the non-transparent section 21*b* and the transparent section 21*a* of the recording medium 21 one on top of the other. Subsequently, the recording medium 21 is discharged in a J direction in FIG. 20.

Figure 23:
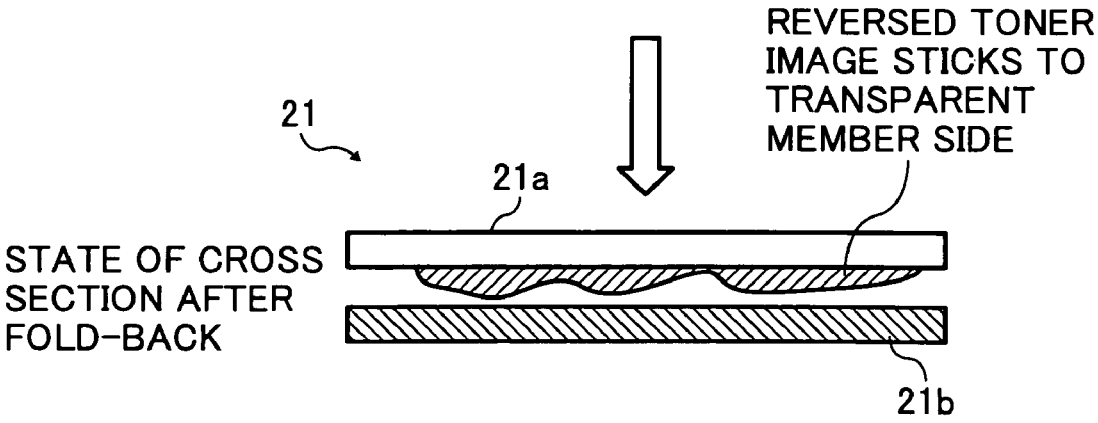
FIG. 23 is a schematic sectional view of a state formation of an image on a recording medium according to the eleventh embodiment.
Figure 24:
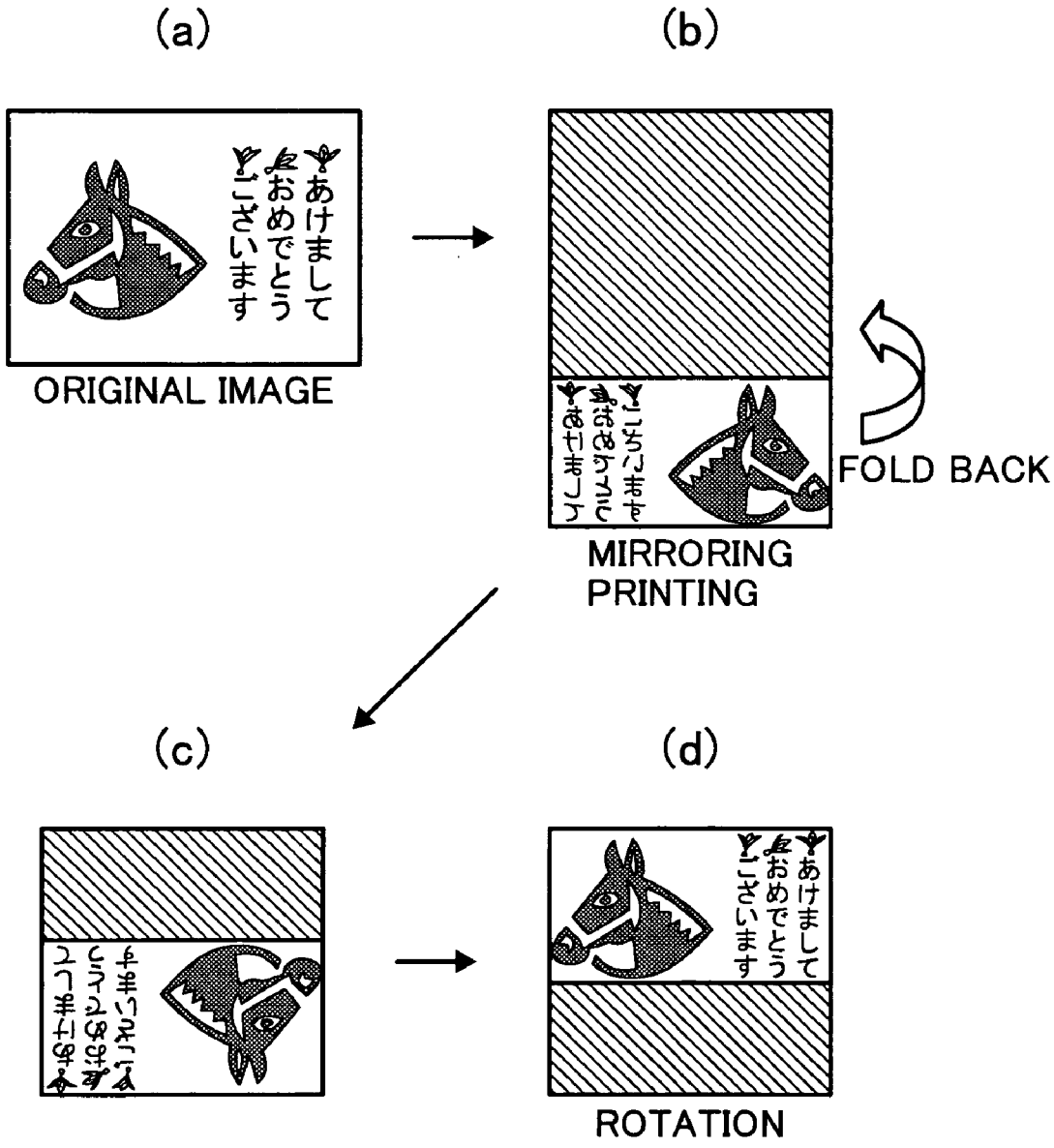
FIG. 24 is schematic diagram for explaining mirroring printing of an image according to the eleventh embodiment.
Figure 25:
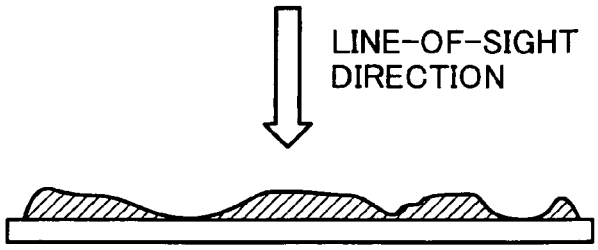
FIG. 25 is a schematic sectional view of a normal printed image for comparison with a printed image according to the eleventh embodiment.

FIG. 23 is a schematic sectional view of a state in which an image is formed on the recording medium according to the eleventh embodiment. FIG. 24 is a schematic diagram for explaining mirroring printing of an image according to the eleventh embodiment. FIG. 25 is a schematic sectional view of a usual printed image for comparison with a printed image according to the eleventh embodiment.

The image formed as described above is outputted in a form of a toner layer present between the transparent section 21*a* and the non-transparent section 21*b* of the recording medium 21 as shown in FIG. 23. The image is printed by mirroring in a procedure shown in FIG. 24 on the assumption that the image is bent. Thus, the toner image surface is seen from the rear side via the transparent section 21*a* as shown in FIG. 23.

Compared with the image surface in FIG. 23, a normal printed image in FIG. 25 lacks smoothness because an uneven toner surface is directly seen. However, when the toner image formed by the image forming apparatus according to the eleventh embodiment is seen via the transparent section 21*a*, since the toner surface without unevenness is present in a line-of-sight direction, the toner image looks like a smooth image. Moreover, since reflected light on the surface of the transparent section 21*a* is also caught by the eyes, the toner image looks like a photographic image because of the planarity of the toner image and the reflected light of the transparent section 21*a*.

Figure 26A:
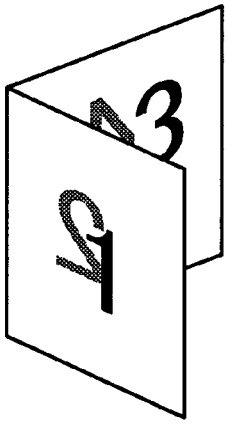
FIGS. 26A and 26B are schematic diagrams of image surface layout at the time of center folding processing according to the eleventh embodiment.
Figure 26B:
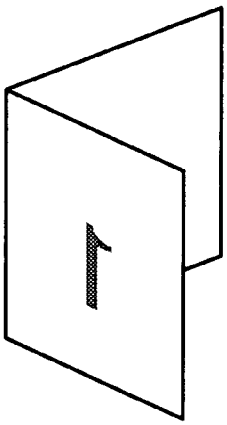

FIGS. 26A and 26B are schematic diagrams of image surface layout at the time of center folding processing according to the eleventh embodiment. When a recording medium is subjected to the center folding processing, as shown in FIG. 26A, an image formation surface is usually laid out to place a first surface on the outer side with respect to the center fold. However, in the eleventh embodiment, since the recording medium is center-folded without reversing an image, as shown in FIG. 26B, the first surface is placed on the inner side. In other words, in layout of an image surface for a recording medium for photographic print, the image surface is placed on a transparent section side of the recording medium.

As described above, according to the eleventh embodiment, the center folding device is additionally arranged in the position behind the position where a recording medium passes the fixing unit of the conventional image forming apparatus to automatically apply the center folding processing to the recording medium on which an image is formed. This makes it possible to obtain a highly glossy photographic image.

A twelfth embodiment of the present invention is explained. In the twelfth embodiment, the structure of the center folding device added as the post-processing device of the image forming apparatus is changed. Therefore, in the twelfth embodiment, image formation on an image recording medium is performed according to operations that are the same as those performed by the image forming apparatus according to the first embodiment. A center folding operation after image formation is explained below.

Figure 27:
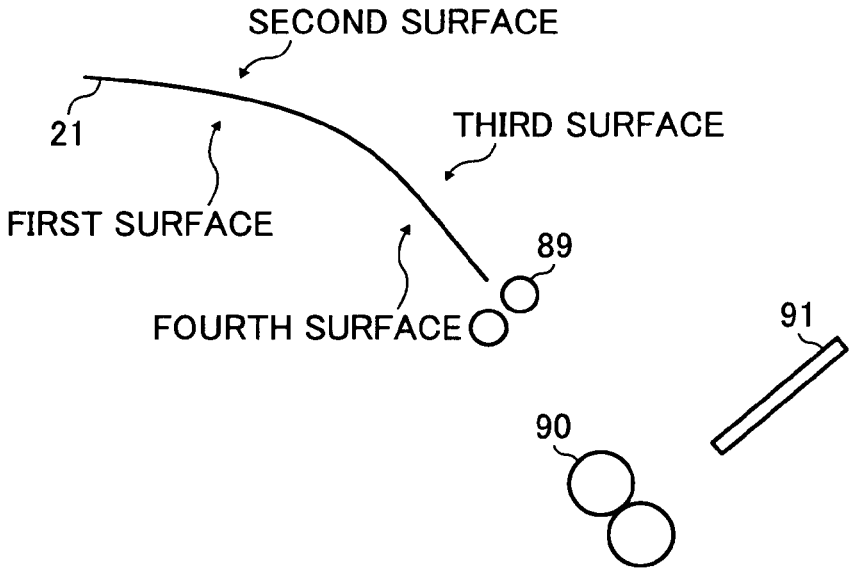
FIG. 27 is a schematic diagram of a surface of a recording medium before a center folding operation is started in electrophotographic post-processing according to a twelfth embodiment of the present invention.
Figure 28A:
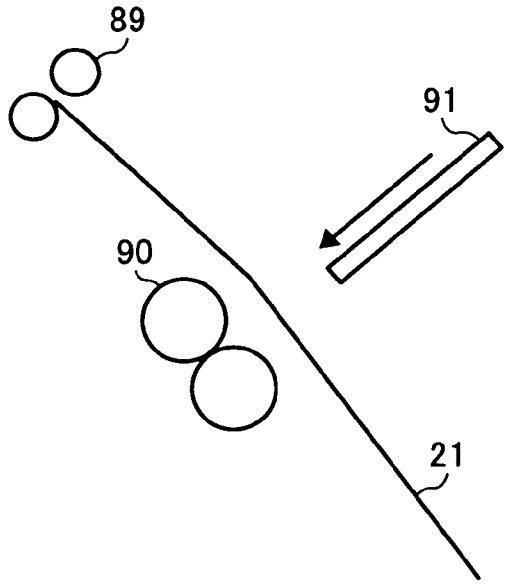
FIGS. 28A to 28C are schematic diagrams of a flow of the center folding operation in the electrophotographic post-processing according to the twelfth embodiment.
Figure 28B:
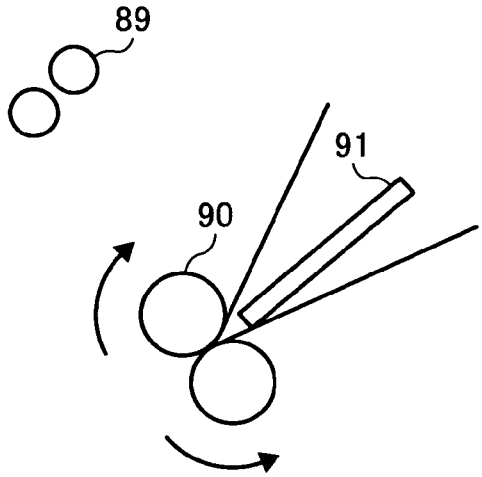
Figure 28C:
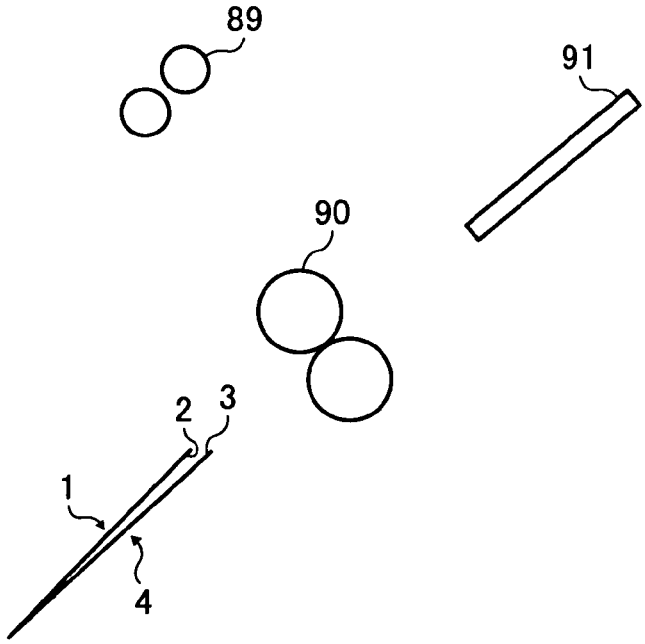

FIG. 27 is a schematic diagram of a surface of a recording medium before starting the center folding operation in electrophotographic post processing according to the twelfth embodiment. FIGS. 28A to 28C are schematic diagrams of a flow of the center folding operation in the electrophotographic post-processing according to the twelfth embodiment.

Referring to FIG. 27 and FIGS. 28A to 28C, the recording medium 21 is reversed and discharged with a first surface and a fourth surface placed on the outer side and a second surface and a third surface placed on the inner side. The recording medium 21 is conveyed to a roller pair 90 and a center folding plate 91, which serve as a center-folding processing unit, by a roller pair 89 (FIG. 28A). The center of the recording medium 21 is pushed from the outside by the center folding plate 91 (FIG. 28B) and passed through the roller pair 90. This makes it possible to fold one or a plurality of media. After the center folding processing, an image surface is laid out as shown in FIG. 26B.

Figure 29:
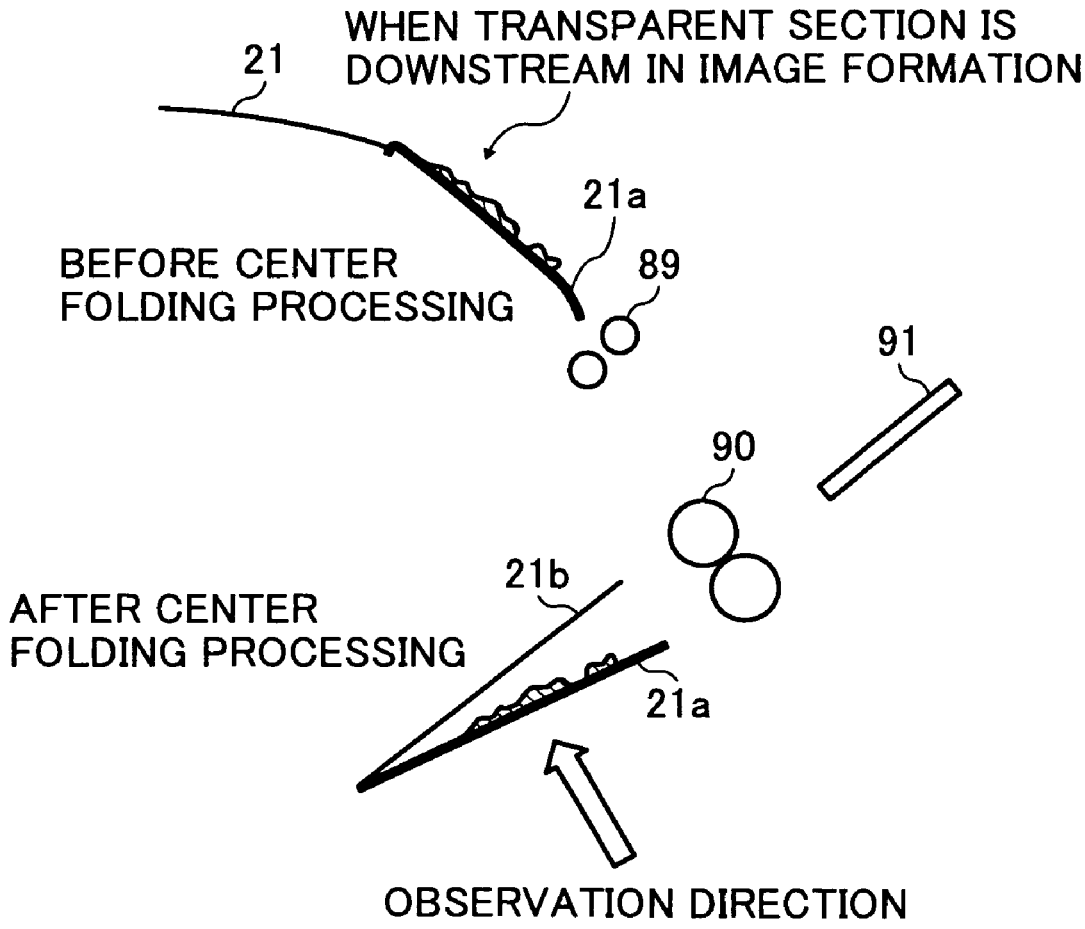
FIG. 29 is a schematic diagram of states before and after the center folding processing at the time when a transparent section of a recording medium is downstream in a conveying direction according to the twelfth embodiment.
Figure 30:
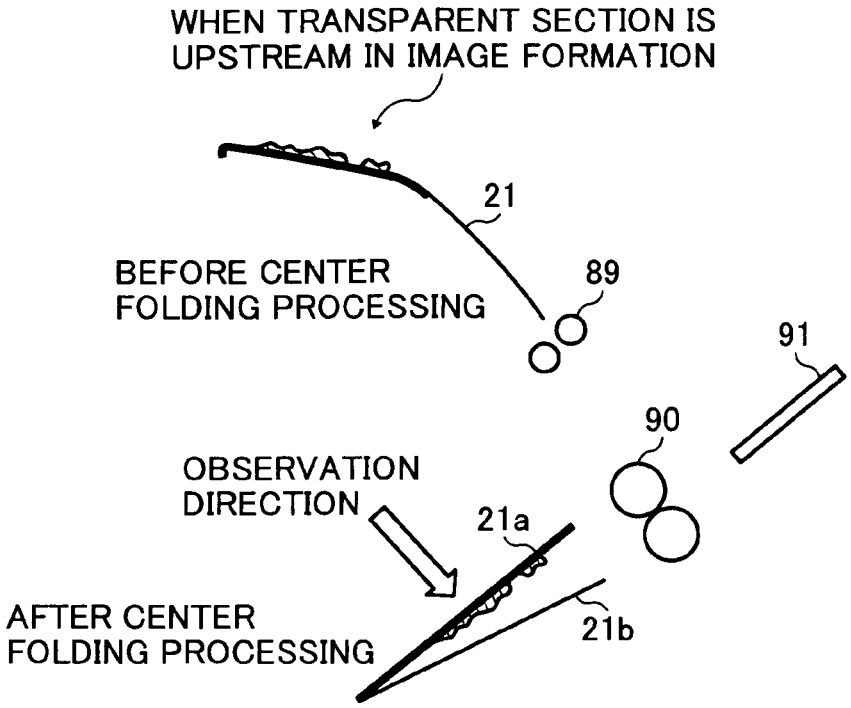
FIG. 30 is a schematic diagram of a state before and after the center folding processing at the time when the transparent section of the recording medium is upstream in the conveying direction according to the twelfth embodiment.

FIG. 29 is a schematic diagram of states before and after the center folding processing at the time when a transparent section of a recording medium is downstream in a conveying direction according to the twelfth embodiment. FIG. 30 is a schematic diagram of states before and after the center folding processing at the time when the transparent section of the recording medium is upstream in the conveying direction according to the twelfth embodiment.

Referring to FIGS. 29 and 30, unlike the general usage in FIG. 25 and FIGS. 26A and 26B, an image is formed on the inner side of the fold. The transparent section 21*a* of the recording medium 21 having an image, which is located downstream (FIG. 29) or upstream (FIG. 30) with respect to the conveying direction, is conveyed to the roller pair 90 and the center folding plate 91, which serve as the center-folding processing unit, by the roller pair 89 without being reversed. Subsequently, the center of the recording medium 21 is pushed from the outside by the center folding plate 91 and passed through the roller pair 90. This makes it possible to fold one recording medium.

Since the surface of the recording medium 21 having the image is the transparent section 21*a*, when the image is seen from the rear surface of the recording medium, the image is a photographic image having uniform glossiness. Since the image surface is not directly touched, a storage life of the image is satisfactory. Moreover, since a surface opposed to the image surface is non-transparent white, a color of the image is clear. Therefore, it is possible to obtain a more preferable image.

A heat-sensitive adhesive layer formed on the non-transparent white surface opposed to the image surface is described below. The heat-sensitive adhesive contains a solid plasticizer and thermoplastic resin emulsion as essential components and is obtained by mixing a tackifier or the like to these components. A heat-sensitive adhesive material is obtained by coating a mixture of these components over a support member.

An adhesive layer surface of the heat-sensitive adhesive material does not show adhesiveness at all at the room temperature. However, the adhesiveness is developed when the heat-sensitive adhesive material is heated by a heat source. The adhesiveness is maintained for a while even after the heat source is removed (an adhesive state is semi-permanently maintained when the heat-sensitive adhesive material is stuck). It is considered that, first, the solid plasticizer is melted by heating and, then, the thermoplastic resin and the tackifier are melted, whereby the adhesiveness is developed.

In the heat-sensitive adhesive material of this type, unlike the general adhesive material, releasing paper is not used. Thus, the heat-sensitive adhesive material is advantageous in terms of resource saving and environmental problems. Moreover, the heat-sensitive adhesive material can be bonded to a member, to which the heat-sensitive adhesive material is bonded, by heating after being brought into contact with the member. Thus, it is possible to prevent a mistake in bonding the heat-sensitive adhesive material.

The inventor has found that low-temperature adhesion is further facilitated by using, as a compound used for the solid plasticizer, at least one kind of compounds having, in particular, a benzoate group, a benzophenone group, a phenylenediamine group, and a benzothiazole group.

As specific examples, as shown in Tables 1 and 2, there is a compound 1 as the compound having the benzoate group, there are compounds 2, 3, and 4 as the compound having the benzophenone group, there are compounds 5 and 6 as the compound having the phenylenediamine group, and there are compounds 7, 8, 9, 10, and 11 as the compound having the benzothiazole group. However, the compounds used for the solid plasticizer are not limited to these compounds.

TABLE 1

Compound 1
Melting Point = 151° C.
Symmetry Number 1

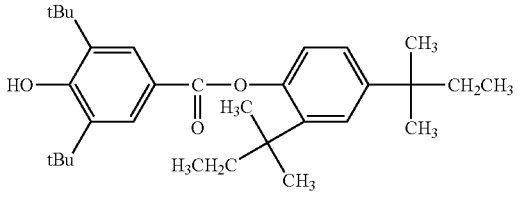

Compound 2
Melting Point = 115° C.
Symmetry Number 1

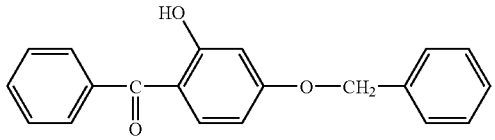

TABLE 1-continued

| | |
|---|---|
| Compound 3<br>Melting Point = 142° C.<br>Symmetry Number 1 | 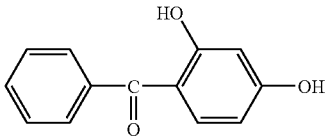 |
| Compound 4<br>Melting Point = 110° C.<br>Symmetry Number 1 | 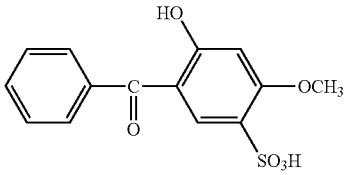 |
| Compound 5<br>Melting Point = 115° C.<br>Symmetry Number 1 | 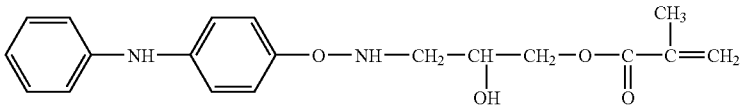 |
| Compound 6<br>Melting Point = 140° C.<br>Symmetry Number 1 | 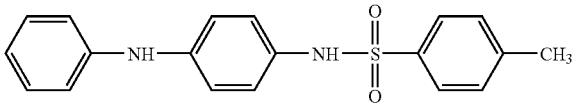 |
| Compound 7<br>Melting Point = 123° C.<br>Symmetry Number 1 | 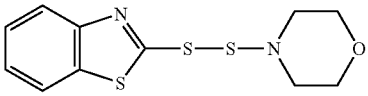 |
| Compound 8<br>Melting Point = 95° C.<br>Symmetry Number 1 | 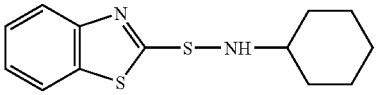 |

TABLE 2

| | |
|---|---|
| COMPOUND 9<br>MELTING POINT = 150° C.<br>SYMMETRY NUMBER 1 | 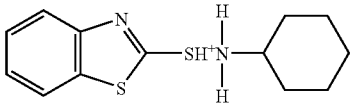 |
| COMPOUND 10<br>MELTING POINT = 155° C.<br>SYMMETRY NUMBER 1 | 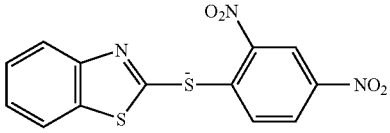 |
| COMPOUND 11<br>MELTING POINT = 95° C.<br>SYMMETRY NUMBER 1 | 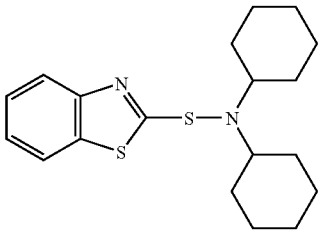 |

TABLE 2-continued

| | |
|---|---|
| COMPOUND 12<br>MELTING POINT = 148° C.<br>SYMMETRY NUMBER 1 | 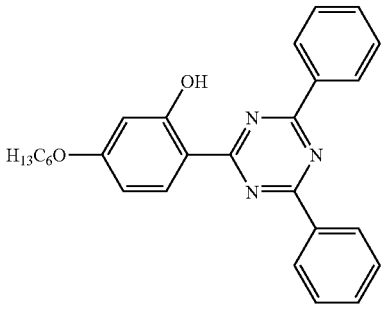 |
| COMPOUND 13<br>MELTING POINT = 95.5° C.<br>SYMMETRY NUMBER 1 | 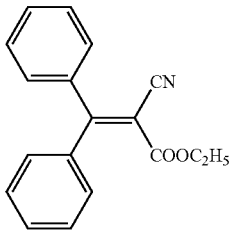 |

Among these compounds, in particular, the compound 1 having the benzoate group, the compound 2 having the benzophenone group, the compound 5 having the phenylenediamine group, and the compound 7 having the benzothiazole group have high compatibility with the thermoplastic resin and the tackifier. Thus, these compounds show high adhesiveness under the low-temperature environment.

Examples of the thermoplastic resin emulsion forming the heat-sensitive adhesive layer are described below. However, the thermoplastic resin emulsion is not limited to these examples. Examples of types of the thermoplastic resin emulsion include resin such as a (meta)acrylic ester copolymer, a styrene-isoprene copolymer, a styrene-acrylic ester copolymer, a styrene-butadiene copolymer, an acrylonitrile-butadiene copolymer, an ethylene-vinyl acetate copolymer, a vinyl acetate-acrylic ester copolymer, an ethylene-chloroethylene copolymer, an ethylene-acrylic ester copolymer, a vinyl acetate-ethylene-chloroethylene copolymer, a vinyl acetate-ethylene-acrylic ester copolymer, a vinyl acetate-ethylene-styrene copolymer, polybutadiene, and polyurethane.

It has been found that, it is possible to realize high adhesiveness when the acrylic ester copolymer is used as the thermoplastic resin emulsion of the heat-sensitive adhesive layer and that 2-ethylhexyl acrylate of the acrylic ester copolymer is resin that improves adhesion.

It is possible to add a tackifier to the heat-sensitive adhesive layer to improve adhesion. Specific examples of the tackifier include terpene resin, aliphatic petroleum resin, aromatic petroleum resin, coumarone-indene resin, styrene resin, phenolic resin, terpene phenol resin, and colophonium derivative resin. The tackifier is mixed at a ratio equal to or lower than 2.0 parts per million and preferably at a ratio in a range of 0.2 to 1.5 parts per million to 1.0 parts per million of the thermoplastic resin. When the tackifier exceeding 2.0 parts per million is mixed, blocking tends to occur.

When an anti-blocking agent is added in the heat-sensitive adhesive layer, blocking in the high-temperature environment is further prevented. Examples of the anti-blocking agent include a wax and an inorganic filler. Examples of the anti-blocking agent are listed below. However, the anti-blocking agent is not limited to the examples.

Examples of the wax include waxes such as animal and vegetable waxes and a synthetic wax, higher fatty acid, higher fatty acid amide other than N-hydroxymethyl stearic amide and stearic amide, higher fatty acid anilide, acetylide of aromatic amine, a paraffin wax, a haze wax, a carnauba wax, shellac, a montan wax, paraffin oxide, a polyethylene wax, and polyethylene oxide.

Examples of the higher fatty acid include stearic acid and behenic acid. Examples of the higher fatty acid amide include stearic amide, oleic amide, N-methyl stearic amide, erucamide, methylol behenic amide, methylol stearic amide, methylene bisstearic amide, and ethylene bisstearic amide. Examples of the higher fatty acid anilide include stearic anilide and linoleate anilide. Examples of the acetylide of aromatic amine include acetotoluidide.

Examples of a heat fusion material other than waxes include a leuco dye and a developer generally used for a thermal recording material. The heat fusion materials including the wax desirably have as high a melting point as possible to prevent the heat fusion materials from affecting adhesion.

Examples of the inorganic filler include carbonates, oxides, hydroxides, sulfates, and the like of aluminum, zinc, calcium, magnesium, barium, titanium, and the like and an inorganic pigment containing clays such as natural silica, zeolite, kaolin, and calcined kaolin. These inorganic fillers desirably have as low oil absorption as possible to prevent the inorganic fillers from affecting adhesion.

These anti-blocking agents are mixed at a ratio equal to or lower than 1.5 parts per million and preferably at a ratio in a range of 0.6 to 1.0 parts per million to 1.0 parts per million of the thermoplastic resin. When the anti-blocking agent exceeding 1.5 parts per million is mixed, adhesion tends to fall.

For the purpose of improving adhesion of the heat-sensitive adhesive layer and the support member or cohesion in the heat-sensitive adhesive layer, it is possible to add an aqueous polymeric binder, for example, polyvinyl alcohol, polyvinyl acetate, oxidized starch, etherified starch, a cellulose derivative such as carboxymethyl cellulose or hydroxyethyl cellulose, casein, gelatin, or alginic acid soda to the heat-sensitive adhesive layer.

The aqueous polymeric binder is added at a ratio not spoiling original adhesion of a heat-sensitive adhesive sheet. Specifically, the aqueous polymeric binder is added at a ratio equal to or lower than 30% by weight and preferably equal to or lower than 10% by weight to a total solid content of the heat-sensitive adhesive layer. It is possible to add various additives such as a hardener, antiseptics, a dye, a developer, a pH moderator, and an anti-foaming agent to the heat-sensitive adhesive layer according to the present invention as required.

A melting point of the solid plasticizer and the thermoplastic resin of the heat-sensitive adhesive layer is lower than a melting point of the toner. If the heating is performed at a temperature between the melting points, it is possible to bond heat-sensitive adhesive material to the member without melting the toner and disturbing the image.

As described above, according to the twelfth embodiment, as shown in FIG. 23, it is possible to obtain an image by looking at the print surface without unevenness via the transparent section of the recording medium.

Therefore, it is possible to easily obtain a photographic image having a satisfactory storage life, which conventionally requires a complicated structure or a complicated procedure, simply by supplying the non-transparent section and the transparent section of the recording medium to the image forming apparatus. According to the twelfth embodiment, it is possible to use the center folding function in the post-processing device. Therefore, it is possible to automatically obtain a photographic image.

A thirteenth embodiment of the present invention is explained. In the thirteenth embodiment, the structure of the center folding device added as the post-processing device of the image forming apparatus is changed. Therefore, in the thirteenth embodiment, image formation on an image recording medium is performed according to operations that are the same as those performed by the image forming apparatus according to the first embodiment. An internal structure of the image recording medium and a center folding operation after image formation are explained below.

Figure 31:
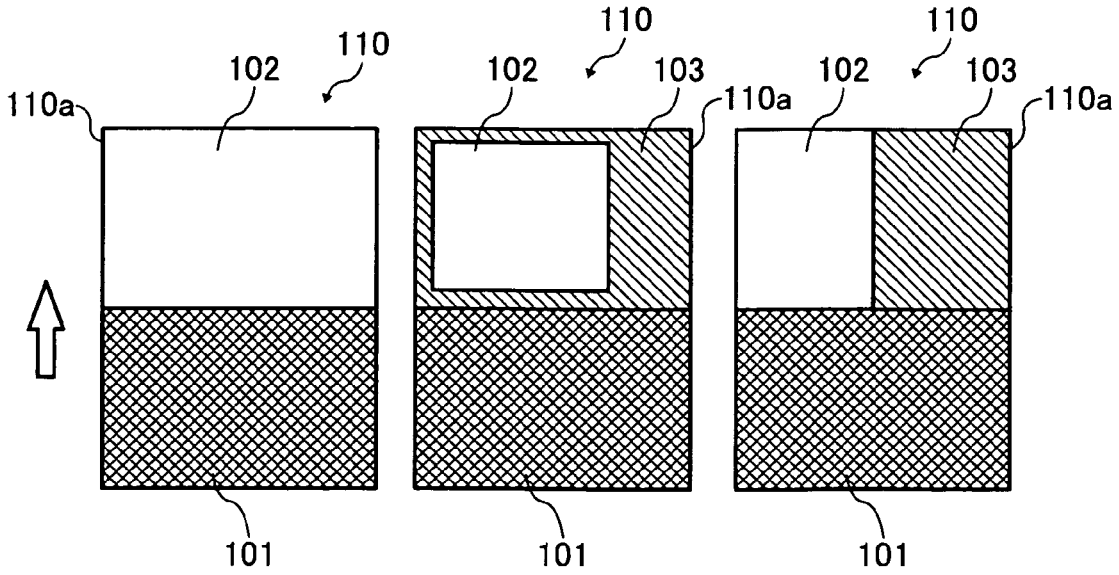
FIG. 31 is a plan view of examples of an image recording medium according to a thirteenth embodiment of the present invention.

FIG. 31 is a plan view of an example of an image recording medium according to the thirteenth embodiment. In an image recording medium 110, a recording medium section 110*a* having a transparent section 102 and a second medium section 101 including a heat-sensitive adhesive layer at least on one side thereof are arranged side by side on one sheet. The recording medium section 110*a* may have the transparent section 102 and a non-transparent section 103 in a part thereof or may have the transparent section 102 in one half and the non-transparent section 103 in the other half. Alternatively, the entire recording medium section 110*a* may be the transparent section 102. Since the second medium section 101 is non-transparent in this way, it is possible to easily recognize a color.

Figure 32:
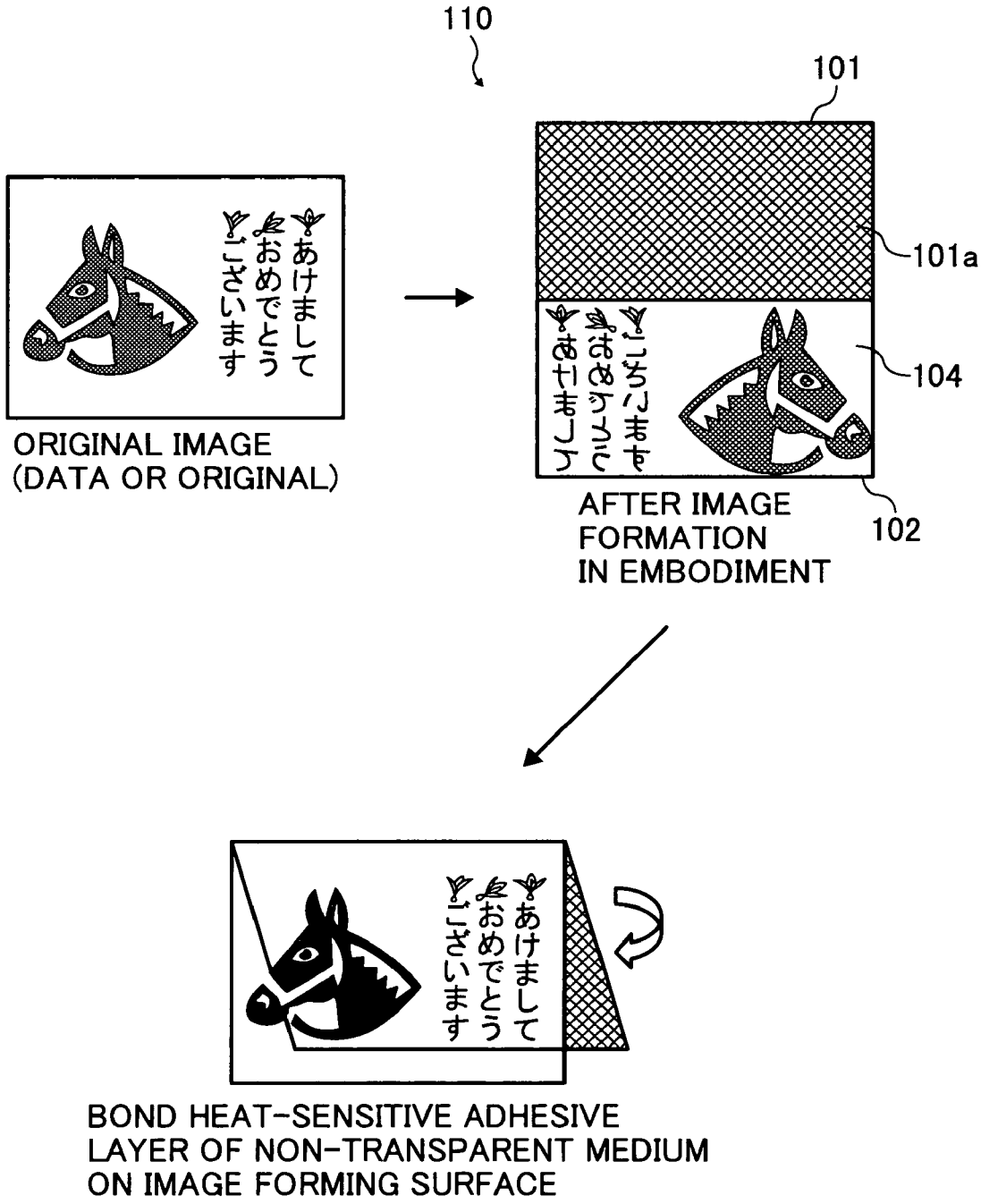
FIG. 32 is a diagram of a procedure of image formation on a recording medium according to the thirteenth embodiment.

FIG. 32 is a diagram of a procedure of image formation on the recording medium according to the thirteenth embodiment. An image is formed in the transparent section 102 of the recording medium section 110*a*. The second medium section 101 having a heat-sensitive adhesive layer formed thereon is folded and superimposed on an image formation surface 104 of the recording medium section 110*a* and integrated with the image formation surface 104. Consequently, a photographic image is obtained (see FIG. 32). Therefore, the image formation surface 104 of the recording medium section 110*a* and a heat-sensitive adhesive layer surface 101*a* of the second medium section 101 are on the same side.

Since the second medium section 101 forms a background color, if a full-color photograph image is outputted, the second medium 10 is usually white. However, if a monotone image is outputted, it is not particularly necessary to limit a color of the second medium section 101 to white. A user may select the color of the second medium section 101 as the user likes.

In this way, in the recording medium section 110*a* having the transparent section 102 at least in a part thereof, an image is formed on the recording medium by horizontally or vertically reversing an original image. Thus, when the image is seen from a non-image surface of the transparent recording medium, that is, when the image after output of the image recording medium is seen, it is possible to obtain a normal image that is not reversed.

According to the thirteenth embodiment, in the recording medium section 110*a* having the transparent section 102 at least in a part thereof, at least the surface of the image formation surface 104 of the transparent section 102 is smooth. Thus, it is possible to obtain a photographic image that is smooth and adheres to the image formation surface 104.

The heat-sensitive adhesive layer formed on the second medium section 101 is described below.

Figure 33:
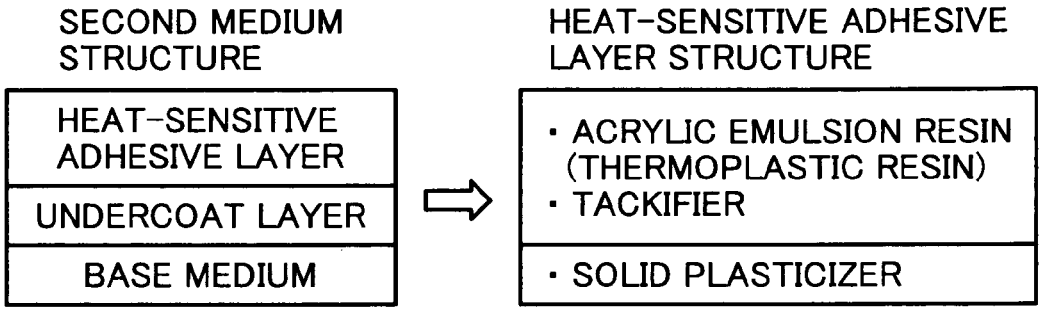
FIG. 33 is a diagram of a structure of a second medium of the recording medium according to the thirteenth embodiment.

FIG. 33 is a diagram of a structure of the second medium of the recording medium according to the thirteenth embodiment. The heat-sensitive adhesive contains a solid plasticizer and thermoplastic resin emulsion as essential components and is obtained by mixing a tackifier or the like to these components. A heat-sensitive adhesive material is obtained by coating a mixture of a mixture of these components over a support member (see FIG. 33). An adhesive layer surface of the heat-sensitive adhesive material does not show adhesiveness at all at the room temperature. However, the adhesiveness is developed when the heat-sensitive adhesive material is heated by a heat source. The adhesiveness is maintained for a while even after the heat source is removed. First, the solid plasticizer is melted by heating and, then, the thermoplastic resin and the tackifier are melted, whereby the adhesiveness is developed. It is possible to semi-permanently maintain an adhesive state in a stuck state. In the heat-sensitive adhesive material of this type, unlike the general adhesive material, releasing paper is not used. Thus, the heat-sensitive adhesive material is advantageous in terms of resource saving and environmental problems. Moreover, the heat-sensitive adhesive material can be bonded to a member, to which the heat-sensitive adhesive material is bonded, by heating after being brought into contact with the member. Thus, it is possible to prevent a mistake in bonding the heat-sensitive adhesive material.

The inventor has found that low-temperature adhesion is further facilitated by using, as a compound used for the solid plasticizer, at least one kind of compounds having, in particular, a benzoate group, a benzophenone group, a phenylenediamine group, and a benzothiazole group. As specific examples, as shown in Tables 1 and 2, there is a compound 1 as the compound having the benzoate group, there are compounds 2, 3, and 4 as the compound having the benzophenone group, there are compounds 5 and 6 as the compound having the phenylenediamine group, and there are compounds 7, 8, 9, 10, and 11 as the compound having the benzothiazole group. However, the compounds used for the solid plasticizer are not limited to these compounds. Among these compounds, in particular, the compound 1 having the benzoate group, the compound 2 having the benzophenone group, the compound 5 having the phenylenediamine group, and the compound 7 having the benzothiazole group have high compatibility with the thermoplastic resin and the tackifier. Thus, these compounds show high adhesiveness under the low-temperature environment.

Examples of the thermoplastic resin emulsion forming the heat-sensitive adhesive layer are described below. However, the thermoplastic resin emulsion is not limited to these examples. Examples of types of the thermoplastic resin emulsion include resin such as a (meta)acrylic ester copolymer, a styrene-isoprene copolymer, a styrene-acrylic ester copolymer, a styrene-butadiene copolymer, an acrylonitrile-butadiene copolymer, an ethylene-vinyl acetate copolymer, a vinyl acetate-acrylic ester copolymer, an ethylene-chloroethylene copolymer, an ethylene-acrylic ester copolymer, a vinyl acetate-ethylene-chloroethylene copolymer, a vinyl acetate-ethylene-acrylic ester copolymer, a vinyl acetate-ethylene-styrene copolymer, polybutadiene, and polyurethane. It has been found that, it is possible to realize high adhesiveness when the acrylic ester copolymer is used as the thermoplastic resin emulsion of the heat-sensitive adhesive layer and 2-ethylhexyl acrylate of the acrylic ester copolymer is resin that improves adhesion.

It is possible to add a tackifier to the heat-sensitive adhesive layer to improve adhesion. Specific examples of the tackifier include terpene resin, aliphatic petroleum resin, aromatic petroleum resin, coumarone-indene resin, styrene resin, phenolic resin, terpene phenol resin, and colophonium derivative resin. The tackifier is mixed at a ratio equal to or lower than 2.0 parts per million and preferably at a ratio in a range of 0.2 to 1.5 parts per million to 1.0 parts per million of the thermoplastic resin. When the tackifier exceeding 2.0 parts per million is mixed, blocking tends to occur.

When an anti-blocking agent is added in the heat-sensitive adhesive layer, blocking in the high-temperature environment is further prevented. Examples of the anti-blocking agent include a wax and an inorganic filler. Examples of the anti-blocking agent are listed below. However, the anti-blocking agent is not limited to the examples.

Examples of the wax include waxes such as animal and vegetable waxes and a synthetic wax, higher fatty acid, higher fatty acid amide other than N-hydroxymethyl stearic amide and stearic amide, higher fatty acid anilide, acetylide of aromatic amine, a paraffin wax, a haze wax, a carnauba wax, shellac, a montan wax, paraffin oxide, a polyethylene wax, and polyethylene oxide. Examples of the higher fatty acid include stearic acid and behenic acid. Examples of the higher fatty acid amide include stearic amide, oleic amide, N-methyl stearic amide, erucamide, methylol behenic amide, methylol stearic amide, methylene bisstearic amide, and ethylene bisstearic amide. Examples of the higher fatty acid anilide include stearic anilide and linoleate anilide. Examples of the acetylide of aromatic amine include acetotoluidide. Examples of a heat fusion material other than the waxes include a leuco dye and a developer generally used for a thermal recording material. The heat fusion materials including the wax desirably have as high a melting point as possible to prevent the heat fusion materials from affecting adhesion. Examples of the inorganic filler include carbonates, oxides, hydroxides, sulfates, and the like of aluminum, zinc, calcium, magnesium, barium, titanium, and the like and an inorganic pigment containing clays such as natural silica, zeolite, kaolin, and calcined kaolin. These inorganic fillers desirably have as low oil absorption as possible to prevent the inorganic fillers from affecting adhesion. These anti-blocking agents are mixed at a ratio equal to or lower than 1.5 parts per million and preferably at a ratio in a range of 0.6 to 1.0 parts per million to 1.0 parts per million of the thermoplastic resin. When the anti-blocking agent exceeding 1.5 parts per million is mixed, adhesion tends to fall.

For the purpose of improving adhesion of the heat-sensitive adhesive layer and the support member or cohesion in the heat-sensitive adhesive layer, it is possible to add an aqueous polymeric binder, for example, polyvinyl alcohol, polyvinyl acetate, oxidized starch, etherified starch, a cellulose derivative such as carboxymethyl cellulose or hydroxyethyl cellulose, casein, gelatin, or alginic acid soda to the heat-sensitive adhesive layer. The aqueous polymeric binder is added at a ratio not spoiling original adhesion of a heat-sensitive adhesive sheet. Specifically, the aqueous polymeric binder is added at a ratio equal to or lower than 30% by weight and preferably equal to or lower than 10% by weight to a total solid content of the heat-sensitive adhesive layer. It is possible to add various additives such as a hardener, antiseptics, a dye, a developer, a pH moderator, and an anti-foaming agent to the heat-sensitive adhesive layer according to the present invention as required.

Figure 34:
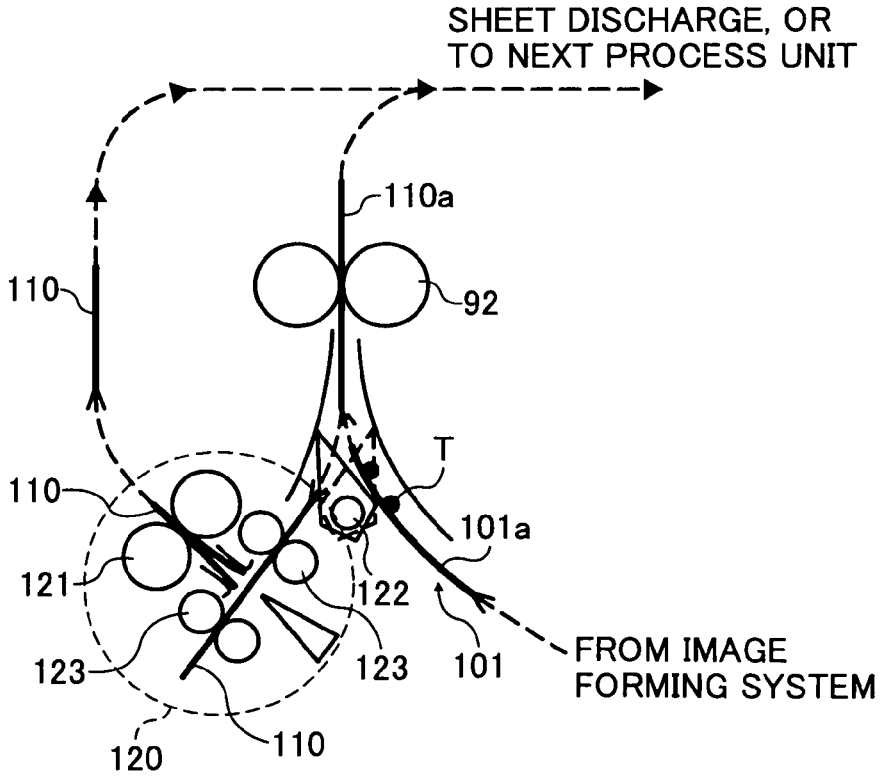
FIG. 34 is a sectional view of a structure around a heating device and a folding device according to the thirteenth embodiment.
Figure 35:
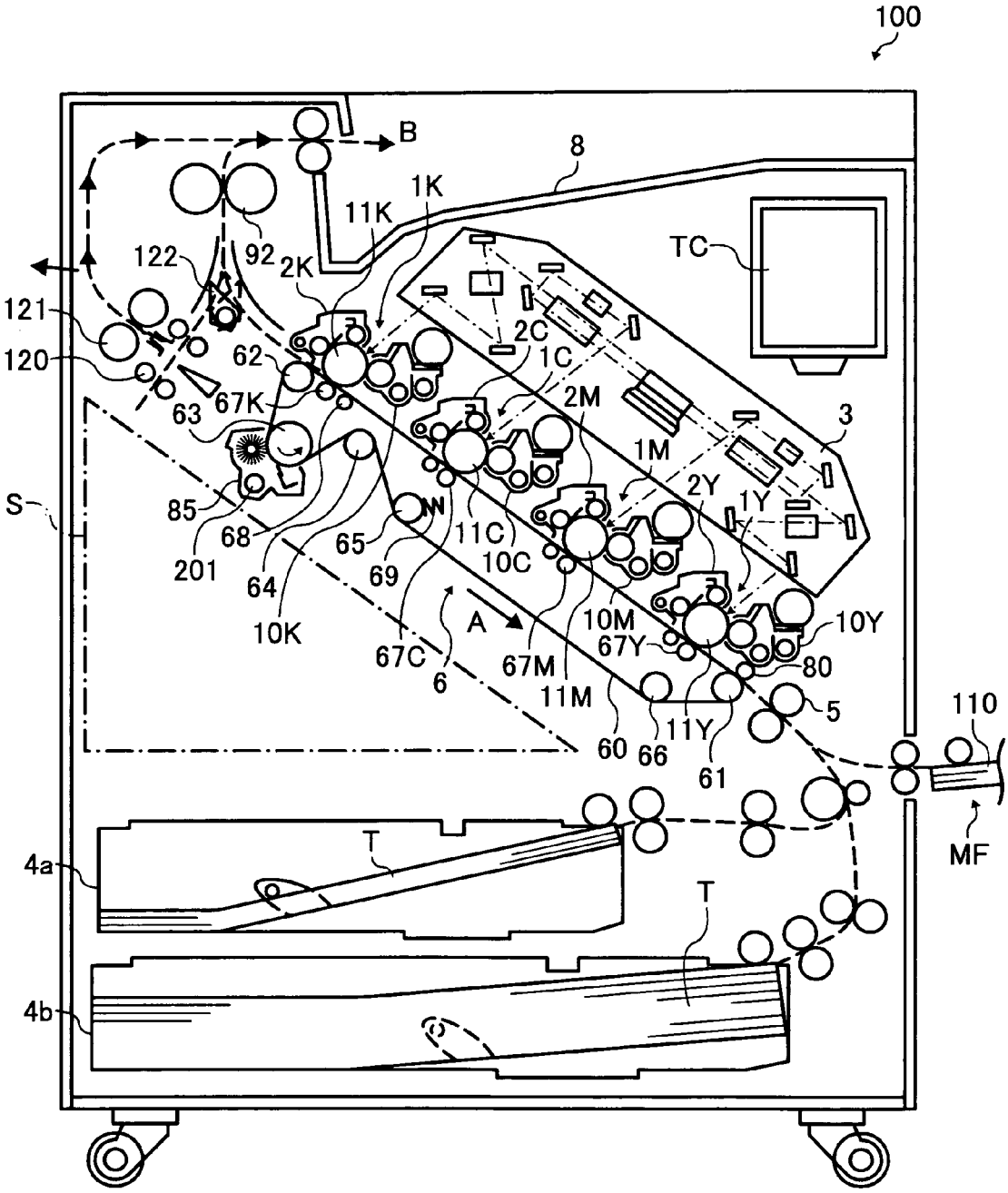
FIG. 35 is a diagram of an entire apparatus mounted with the heating device and the folding device according to the thirteenth embodiment.

FIG. 34 is a sectional view of a structure around a heating device and a folding device according to the thirteenth embodiment. FIG. 35 is a diagram of an entire apparatus mounted with the heating device and the folding device according to the thirteenth embodiment.

The heat-sensitive adhesive layer is formed in the second medium section 101. The heat-sensitive adhesive layer does not show adhesiveness at all at the room temperature. Thus, there are advantages that it is possible to stock the image recording medium 110 in the sheet feeding tray with one placed on top of another and it is possible to easily convey the medium without providing a special peeling layer. In FIG. 35, the image recording medium 110 is placed in the manual feed tray MF.

When image formation is performed using a toner in the normal electrophotographic system, it is necessary to fix a toner image first. Usually, since the fixing is performed by heating, only an area having the toner image formed thereon of the recording medium section 110*a* in the image recording medium 110 is moved through a fixing device 92. The second medium section 101 having the heat-sensitive adhesive layer 101*a* formed therein has to be prevented from being moved through the fixing device 92.

An example of a method for conveyance of the image recording medium 110 is explained with reference to FIG. 34. The recording medium section 110*a* is set as a leading section of conveyance of the image recording medium 110. When the area having the toner image placed thereon of the recording medium section 110*a* passes the fixing device 92, the conveyance is reversed. In this case, since the area moves back and forth through the fixing device 92, it goes without saying that a fixing temperature and the like have to be optimized in this mode. Moreover, when the trailing end of the image recording medium 110 passes a conveyance-path switching pawl 122, the conveyance-path switching pawl 122 is changed over to a position indicated by a dotted line in FIG. 34 and the fixing device 92 is reversely rotated to convey the image recording medium 110 to a folding device 120. When the image recording medium 110 enters the folding device 120, folding processing is executed by folding rollers 121, two pairs of conveying rollers 123, and a pawl 124.

When a toner is a toner of a non-heat fixing type that is fixed by a chemical rather than by heating, it is easy to treat the second medium section 101 because heat is not used. Thus, the second medium section 101 may also be moved through the fixing device 92.

Figure 36:
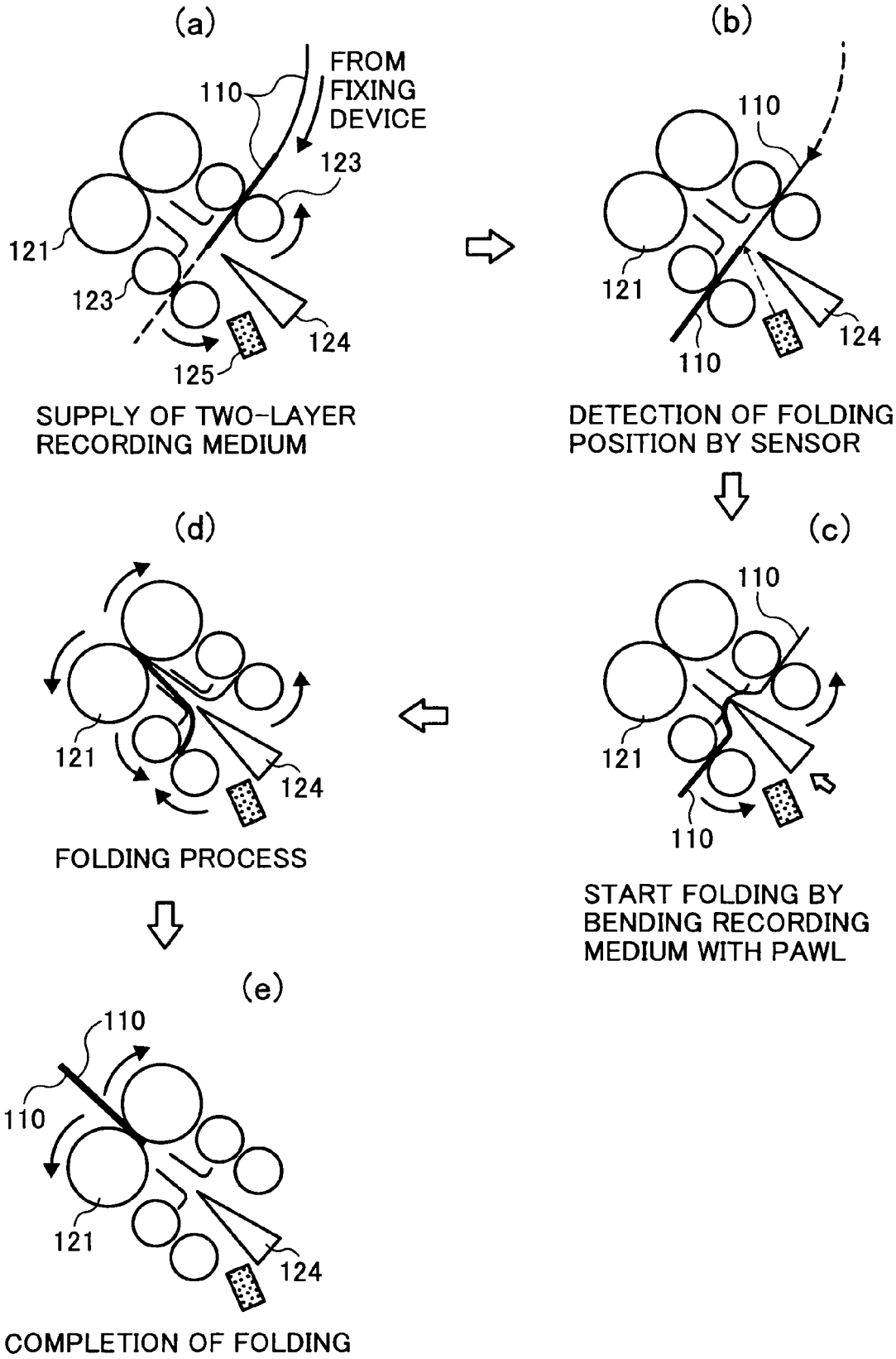
FIG. 36 is a schematic diagram for explaining a folding process of a center folding device according to the thirteenth embodiment.

After the image recording medium 110 is led to the folding device 120 ((a) shown in FIG. 36), the image recording medium 110 is folded as shown in FIG. 36. FIG. 36 is a schematic diagram for explaining a folding process of a center folding device according to the thirteenth embodiment. The recording medium section 110*a* and the second medium section 101 of the image recording medium 110 are supported by the conveying rollers 123, respectively ((b) shown in FIG. 36). After the pawl 124 is placed in a folding position to bend the image recording medium 110, the conveying rollers 123 convey the image recording medium 110 while the respective pairs rotating in opposite directions to bend the image recording medium 110 ((c) shown in FIG. 36). Then, the image recording medium 110 is conveyed in a bent state. As a result, it is possible to completely fold the image recording medium 110 with the folding rollers 121 ((d) shown in FIG. 36).

In this way, when an image is formed on the image recording medium 110 using the toner, after a toner image is fixed on the image recording medium 110 having the transparent section 102 at least in a part thereof, bending of the image recording medium 110 by the folding device 120 and heat-bonding of the image recording medium 110 by the heating device are performed. Thus, it is possible to fold and bond the image recording medium 110 without disturbing the image on the image recording medium 110.

Figure 37:
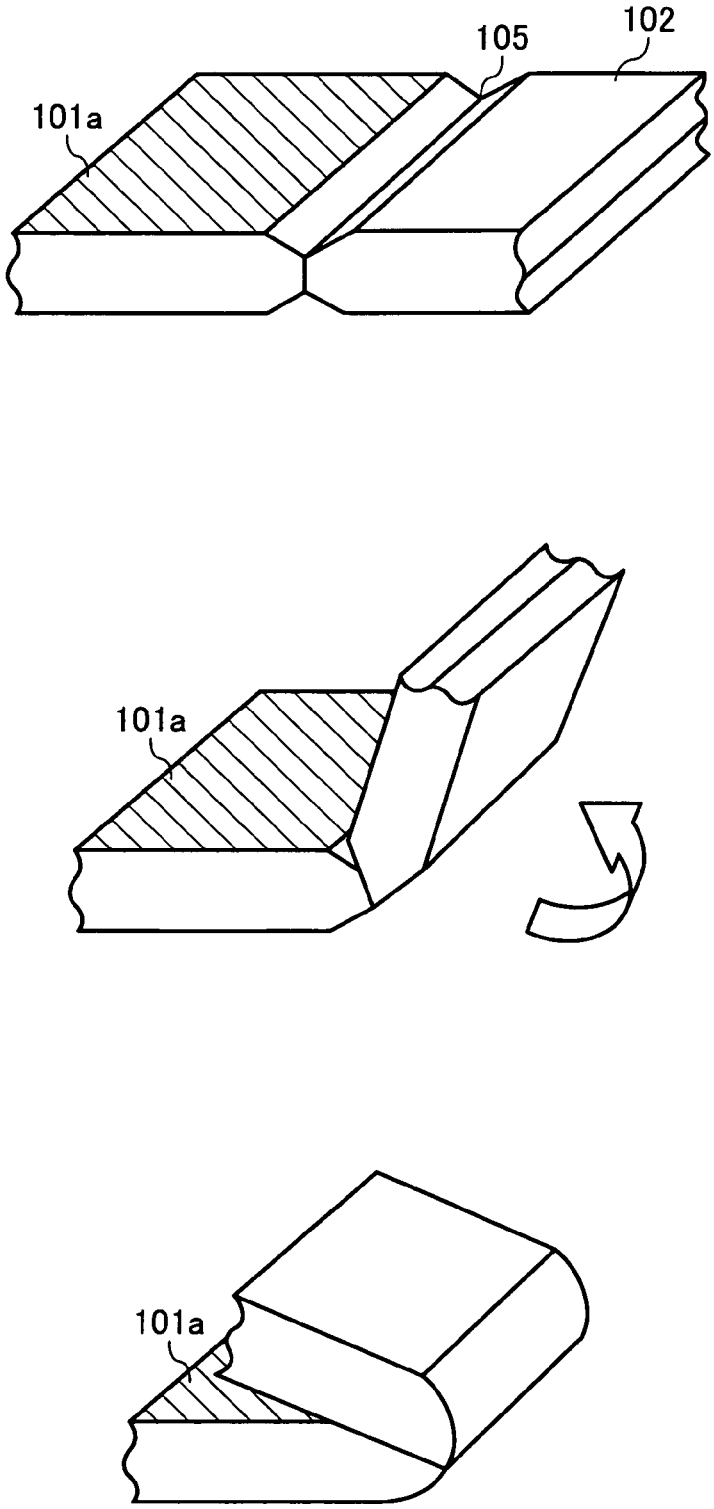
FIG. 37 is a diagram of an image recording medium having a concave line according to the thirteenth embodiment.

In this case, a concave line 105 is provided (FIG. 37) or perforations are provided on a surface at least on one side of a target position for folding the image recording medium 110 along the boundary between the recording medium section 110*a* and the second medium section 101 of the image recording medium 110. This makes it possible to easily superimpose the recording medium section 110*a* and the second medium section 101 one on top of the other without causing misregistration when the image recording medium 110 is folded along the boundary. FIG. 37 is a diagram of an image recording medium that has a concave line according to the thirteenth embodiment.

As indicated by (b) shown in FIG. 36, if a sensor 125 that can detect the boundary (or detect a distance from a leading edge or a trailing end of the image recording medium 110) is provided, it is possible to perform folding of the image recording medium 110 more accurately and with less percent defective.

After the folding, it is necessary to bond the surfaces of the image recording medium 110 superimposed one on top of the other. Thus, the image recording medium 110 is led to the heating device to activate the heat-sensitive adhesive layer. The heating device may be provided separately from the folding device. However, the image forming apparatus has a simplest structure if the folding rollers 121 also serve as the heating device.

A melting point of the solid plasticizer and the thermoplastic resin of the heat-sensitive adhesive layer is lower than a melting point of the toner. If the heating is performed at a temperature lower than the melting point of the toner and higher than the melting point of the solid plasticizer and the thermoplastic resin, it is possible to bond the surfaces without melting the toner and disturbing the image.

The image forming apparatus also has a path for discharging the image recording medium 110 or conveying the image recording medium 110 to the next process unit without conveying the medium through the folding device and the heating device according to the switching by the conveyance-path switching pawl 122. As the next processing unit, there are a reversal unit for duplex printing, a staple, a center binding unit, a punching unit, a bookbinding unit. This shortcut path is a conveyance path at the time of usual printing in which the second medium is unnecessary and photographic print is not performed. This is a conveyance path necessary for universality of the image forming apparatus. Naturally, it is judged on software whether photographic print is performed or normal print is performed according to a print mode set by the user and the conveyance-path switching pawl 122 is actuated according to the judgment to switch the conveyance path.

As described above, according to the thirteenth embodiment, the image forming apparatus also has the path for discharging the image recording medium 110 or conveying the image recording medium 110 to the next process unit without conveying the medium through the folding device and the heating device. Thus, it is possible to cope with not only conveyance of the recording medium, with which a photographic image quality can be obtained, according to the thirteenth embodiment but also conveyance of other image recording media.

A fourteenth embodiment of the present invention is explained. In the fourteenth embodiment, a fixing device also serves as a heating device. Therefore, in the fourteenth embodiment, image formation on an image recording medium is performed according to operations that are the same as those performed by the image forming apparatus according to the first embodiment. An internal structure of the image recording medium and a center folding operation after image formation are explained below.

Figure 38:
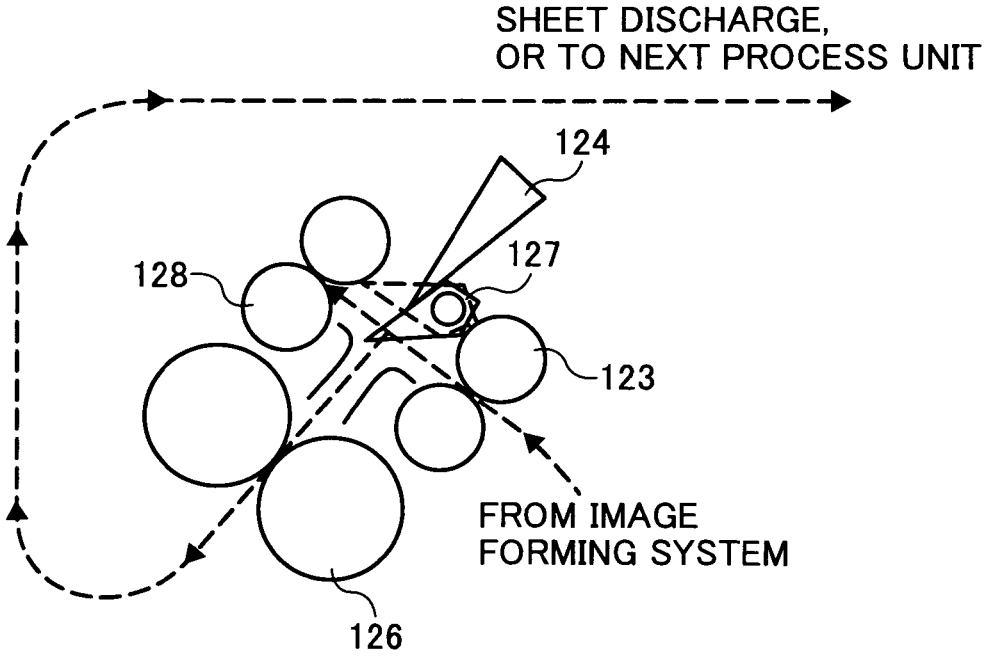
FIG. 38 is a diagram of a structure of a main part serving as a folding device, a heating device, and a fixing device according to a fourteenth embodiment of the present invention.

FIG. 38 is a diagram of a main part serving as a folding device, a heating device, and a fixing device according to the fourteenth embodiment. In this case, an unfixed image is directly carried through the folding device and fixing of a toner image and bonding of a recording medium are simultaneously performed by the heating device. There is a risk of disturbance of the image when the image passes the folding device. However, since the image forming apparatus has a simple structure, it is possible to reduce the number of components of the image forming apparatus. This leads to a reduction in cost. It is also possible to apply the image forming apparatus to a recording method in which fixing of an image is not required such as an ink-jet recording method.

In this case, as in the case described above, the image forming apparatus has a shortcut conveyance path for usual printing in which the second medium section 101 is unnecessary and photographic print is not performed. The conveyance path is explained with reference to FIG. 38. On the conveyance path, the image recording medium 110 is conveyed by an image forming system including a latent image process, a development process, and a transfer process and, then, conveyed to the conveying rollers 123 and fixing rollers 128. When an image is fixed on the image recording medium 110 that does not pass the folding device, after the image recording medium 110 passes the conveying rollers 123, normal fixing processing is executed in the fixing rollers 128. In executing the folding processing, while the image recording medium 110 is held by the conveying rollers 123 and the fixing rollers 128, the conveyance-path switching pawl 127 is changed over and placed in the folding position and the fixing rollers 128 are reversely rotated. The image recording medium 110 is folded and led into folding rollers 126. The image recording medium 110 led into the folding rollers 126 is completely folded by the conveyance by the folding rollers 126 and discharged through a path indicated by a dotted line in FIG. 38. In this way, the image forming apparatus also has the medium conveyance path for supplying the image recording medium 110 to the heating device without conveying the image recording medium 110 through the folding device. Thus, it is also possible to apply the image forming apparatus to conveyance of media other than the image recording medium, with which a photographic image quality can be obtained, according to the fourteenth embodiment.

As described above, according to the fourteenth embodiment, in the image recording medium 110, the recording medium section 110*a* having the transparent section 102 at least in a part thereof and the second medium section 101 including the heat-sensitive adhesive layer at least on one side thereof are arranged side by side on one sheet. After an image is formed in the recording medium section 110*a*, the image recording medium 110 is folded to bond the image formation surface of the recording medium section 110*a* and the surface of the second medium section 101 on which the heat-sensitive adhesive layer is formed. Consequently, an integral medium is formed. The image forming apparatus includes the folding device that folds at least the image recording medium 110 and the heating device that heats the image recording medium 110 folded by the folding device. Thus, the image forming apparatus is excellent in a medium stock property, a medium setting property, and a medium conveyance property in the process of forming a photographic image having a satisfactory storage life.

Furthermore, the image forming apparatus has a selecting unit that selects a medium conveyance path for an arbitrary medium. This makes it possible to switch a conveyance path for a medium that requires a photographic image quality and a medium that does not require the photographic image quality.

Moreover, the selecting unit selects a medium conveyance path according to a print mode. This makes it possible to associate the print mode and necessity of the photographic image quality.

Although the invention has been described with respect to a specific embodiment for a complete and clear disclosures the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a conveyance path configured to convey an image recording medium that includes a recording medium that is a sheet-like medium, on which an image is formed by an image forming apparatus, the recording medium including a transparent section, an overlapping medium configured to overlap the transparent section, and an adhesive layer on which an adhesive is applied;

an image forming unit that forms an image on the image recording medium;

a boundary sensor configured to detect a boundary between the transparent section and the overlapping medium; and a control unit that reverses the image horizontally or vertically when forming the image in the transparent section, wherein the overlapping medium is integrated with an image formation surface of the transparent section via the adhesive layer.

2. An image forming apparatus comprising:

a image forming unit configured to form an image on an image recording medium, wherein the image recording medium includes a recording medium that is a sheet-like medium, on which an image is formed by an image forming apparatus, the recording medium including a transparent section, an overlapping medium configured to overlap the transparent section, and an adhesive layer on which an adhesive is applied, and the overlapping medium is integrated with an image formation surface of the transparent section via the adhesive layer; and a boundary sensor configured to detect a boundary between the transparent section and the overlapping medium.

3. The image forming apparatus according to claim 2, further comprising:

a folding device that folds the image recording medium at a boundary between the recording medium and the overlapping medium; and a heating device that heats the folded image recording medium.

4. The image forming apparatus according to claim 3, wherein the image is formed by using a toner, and after fixing a toner image on the image recording medium, the folding device folds the image recording medium and the heating device heats the folded image recording medium to bond the recoding medium and the overlapping medium.

5. The image forming apparatus according to claim 4, further comprising:

a conveyance path for discharging the image recording medium or supplying the image recording medium to a next processing unit without routing the image recording medium through the folding device and the heating device.

6. The image forming apparatus according to claim 3, wherein the folding device folds the image recording medium and the heating device heats the folded image recording medium to bond the recoding medium and the overlapping medium for an unfixed image on the image recording medium.

7. The image forming apparatus according to claim 6, further comprising:

a conveyance path for supplying the image recording medium to the heating device without routing the image recording medium through the folding device.

8. The image forming apparatus according to claim 5, further comprising:

a selecting unit that selects a conveyance path for the image recording medium according to a print mode.

9. The image forming apparatus according to claim 1, further comprising:

a folding device configured to fold the image recording medium at a boundary between the recording medium and the overlapping medium; and a heating device that heats the folded image recording medium.

10. The image forming apparatus according to claim 1, further comprising:

a folding device including a first roller pair and a second roller pair configured to rotate so as to convey the image recording medium, the second roller pair configured to reversibly rotate in a direction opposite to that of the first roller pair when the boundary between the transparent section and the overlapping medium is aligned with a third roller pair.

11. The image forming apparatus according to claim 10, wherein the second roller pair is configured to reversibly rotate such that the image recording medium sags so as to be nipped by the third roller pair.

12. The image forming apparatus according to claim 2, further comprising:

a folding device including a first roller pair and a second roller pair configured to rotate so as to convey the image recording medium, the second roller pair configured to reversibly rotate in a direction opposite to that of the first roller pair when the boundary between the transparent section and the overlapping medium is aligned with a third roller pair.

13. The image forming apparatus according to claim 12, wherein the second roller pair is configured to reversibly rotate such that the image recording medium sags so as to be nipped by the third roller pair.

* * * * *